US008573945B2

(12) United States Patent
Wang et al.

(10) Patent No.: US 8,573,945 B2
(45) Date of Patent: Nov. 5, 2013

(54) COMPRESSOR STATOR VANE

(75) Inventors: Yong Wang, Palm Beach Gardens, FL (US); James Page Strohl, Stuart, FL (US)

(73) Assignee: Alstom Technology Ltd., Baden (CH)

( * ) Notice: Subject to any disclaimer, the term of this patent is extended or adjusted under 35 U.S.C. 154(b) by 1007 days.

(21) Appl. No.: 12/617,983

(22) Filed: Nov. 13, 2009

(65) Prior Publication Data

US 2011/0116917 A1 May 19, 2011

(51) Int. Cl.
*F01D 5/14* (2006.01)

(52) U.S. Cl.
USPC ..... 416/223 A; 416/243; 416/DIG. 2

(58) Field of Classification Search
USPC ..... 416/23, 223 A, 223 R, 243, DIG. 2, 416/DIG. 5
See application file for complete search history.

(56) References Cited

U.S. PATENT DOCUMENTS

| | | | | |
|---|---|---|---|---|
| 6,398,489 | B1 | 6/2002 | Burdgick et al. | |
| 6,461,109 | B1 | 10/2002 | Wedlake et al. | |
| 6,471,482 | B2 * | 10/2002 | Montgomery et al. | 416/203 |
| 6,503,054 | B1 | 1/2003 | Bielek et al. | |
| 6,722,853 | B1 | 4/2004 | Humanchuk et al. | |
| 6,736,599 | B1 | 5/2004 | Jacks et al. | |
| 6,769,878 | B1 | 8/2004 | Parker et al. | |
| 6,866,477 | B2 | 3/2005 | Arness et al. | |
| 6,887,041 | B2 | 5/2005 | Coke et al. | |
| 6,932,577 | B2 | 8/2005 | Strohl et al. | |
| 6,994,520 | B2 | 2/2006 | Humanchuk et al. | |
| 7,001,147 | B1 | 2/2006 | Phillips et al. | |
| 7,090,463 | B2 * | 8/2006 | Milburn et al. | 415/211.2 |
| 7,094,022 | B2 * | 8/2006 | Bruce | 415/160 |
| 7,247,348 | B2 * | 7/2007 | Power | 427/249.7 |
| 7,329,093 | B2 | 2/2008 | Vandeputte et al. | |
| 7,467,920 | B2 * | 12/2008 | Sullivan et al. | 415/193 |
| 7,497,664 | B2 * | 3/2009 | Walter et al. | 416/223 A |
| 7,527,473 | B2 | 5/2009 | Humanchuk et al. | |
| 7,766,624 | B2 * | 8/2010 | Arinci et al. | 416/223 R |
| 8,221,065 | B2 * | 7/2012 | Greim et al. | 415/192 |
| 2007/0248465 | A1 * | 10/2007 | Botrel et al. | 416/223 A |

* cited by examiner

*Primary Examiner* — Nathaniel Wiehe
*Assistant Examiner* — Ryan Ellis
(74) *Attorney, Agent, or Firm* — Shook, Hardy & Bacon L.L.P.

(57) ABSTRACT

A compressor component having a non-linear thickness distribution along the span length is disclosed. By altering the thickness distribution to a non-linear arrangement so as to locally increase airfoil thickness proximate a mid-span location, the natural frequency of the airfoil is increased so as to not coincide with a critical engine order of the compressor. Further, the present invention provides a novel airfoil profile in accordance with the coordinates of Table 1. The present invention also includes a carrier segment or disk fabricated from a material so as to eliminate corrosion with the compressor component.

17 Claims, 6 Drawing Sheets

COMPRESSOR STATOR VANE

CROSS-REFERENCE TO RELATED APPLICATIONS

Not applicable.

TECHNICAL FIELD

The present invention generally relates to a compressor component having an airfoil and more specifically to an improved airfoil profile that has a variable thickness along the airfoil span in order to raise the natural frequency of the compressor component and minimize excitation of the component.

BACKGROUND OF THE INVENTION

A compressor typically comprises a plurality of stages, where each stage includes a set of stationary compressor vanes which direct a flow of air into a rotating disk of compressor blades, where each stage of the compressor decreases in diameter, causing the pressure and temperature of the air to increase. Compressor components having an airfoil, such as compressor blades and compressor vanes, are held within disks or carriers and are designed to aid in compressing a fluid, such as air, as it passes through stages of blades and vanes of the compressor.

Axial compressors having multiple stages are commonly used in gas turbine engines for increasing the pressure and temperature of air to a pre-determined level at which point a fuel can be mixed with the air and the mixture ignited. The hot combustion gases then pass through a turbine to provide either a propulsive output or mechanical output.

Compressor components, such as blades and vanes, have an inherent natural frequency, and when the compressor component is excited, as would occur during normal operating conditions, the compressor component shakes or moves at different orders of the engine natural frequency. When the natural frequency of the compressor component coincides or crosses an engine order, the compressor component can start to resonate or vibrate in such away that it is excited and can cause cracking or failure of the compressor component.

SUMMARY

In accordance with the present invention, there is provided a novel and improved compressor component having a non-linear airfoil thickness that results in an altered natural frequency of the airfoil. The location of the airfoil thickness has been modified at a distance along the airfoil span so as to shift the natural frequency of the blade with minimal impact to blade aerodynamics and efficiency.

In an embodiment of the present invention, a compressor component has an attachment and an airfoil extending radially outward from the attachment, where the airfoil has a leading edge and a trailing edge, concave and convex surfaces, and a thickness. The thickness of the airfoil between the concave and convex surfaces varies non-linearly along the span of the airfoil.

In an alternate embodiment of the present invention, a compressor component is disclosed having an attachment and an airfoil extending radially outward from the attachment. The airfoil has an uncoated profile substantially in accordance with Cartesian coordinate values of X, Y, and Z as set forth in Table 1, where Z is a distance measured radially from a bottom of the attachment to which the airfoil is mounted.

The X and Y values are joined by smooth connecting splines to form a plurality of airfoil sections and the sections are joined to form the airfoil profile.

In yet another embodiment, a compressor stator having an increased natural frequency is disclosed in which the compressor stator comprises an attachment and an airfoil extending radially outward from the attachment with the airfoil having a variable thickness with at least a first and second maximum thicknesses and a non-linear variation of the thickness.

The enhancements made to the airfoil along its chord length and span are made without impacting the throat area between adjacent blades or overall efficiency while also increasing the natural frequency of the compressor component. As such, parts of the compressor vane have a reduced thickness compared to the prior art, while other areas of the compressor component have an increased thickness. Although disclosed as an airfoil that is uncoated, it is envisioned that an alternate embodiment of the present invention can include an airfoil that is at least partially coated with an erosion resistant coating, corrosion resistant coating, or a combination thereof. In this case, the coordinates of the airfoil as listed in Table 1 would be prior to a coating being applied to any portion of the airfoil.

Additional advantages and features of the present invention will be set forth in part in a description which follows, and in part will become apparent to those skilled in the art upon examination of the following, or may be learned from practice of the invention. The instant invention will now be described with particular reference to the accompanying drawings.

BRIEF DESCRIPTION OF THE SEVERAL VIEWS OF THE DRAWINGS

The present invention is described in detail below with reference to the attached drawing figures, wherein.

DETAILED DESCRIPTION

The subject matter of the present invention is described with specificity herein to meet statutory requirements. However, the description itself is not intended to limit the scope of this patent. Rather, the inventors have contemplated that the claimed subject matter might also be embodied in other ways, to include different components, combinations of components, steps, or combinations of steps similar to the ones described in this document, in conjunction with other present or future technologies.

Figure 1:
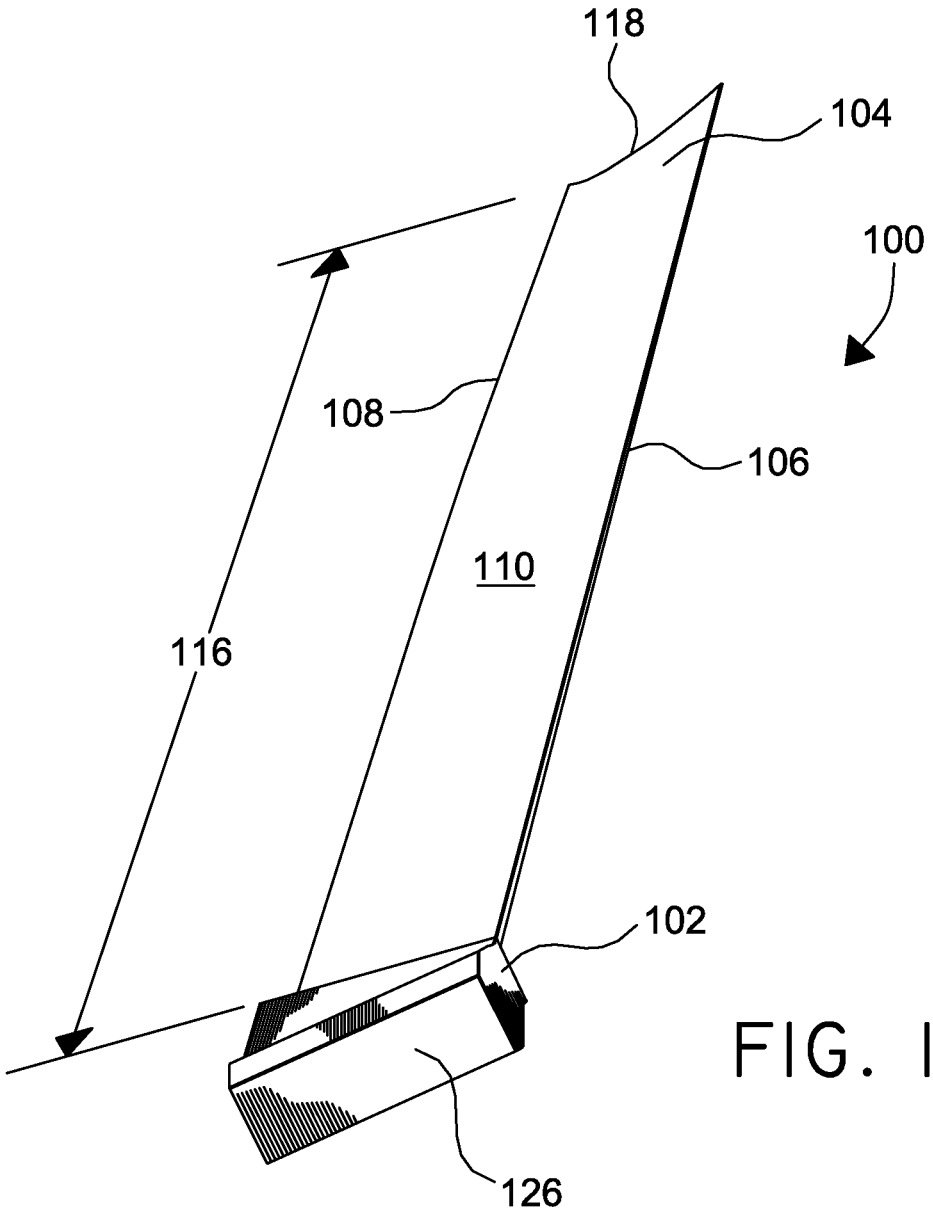
FIG. 1 is a perspective view of a compressor component having an airfoil in accordance with an embodiment of the present invention.
Figure 2:
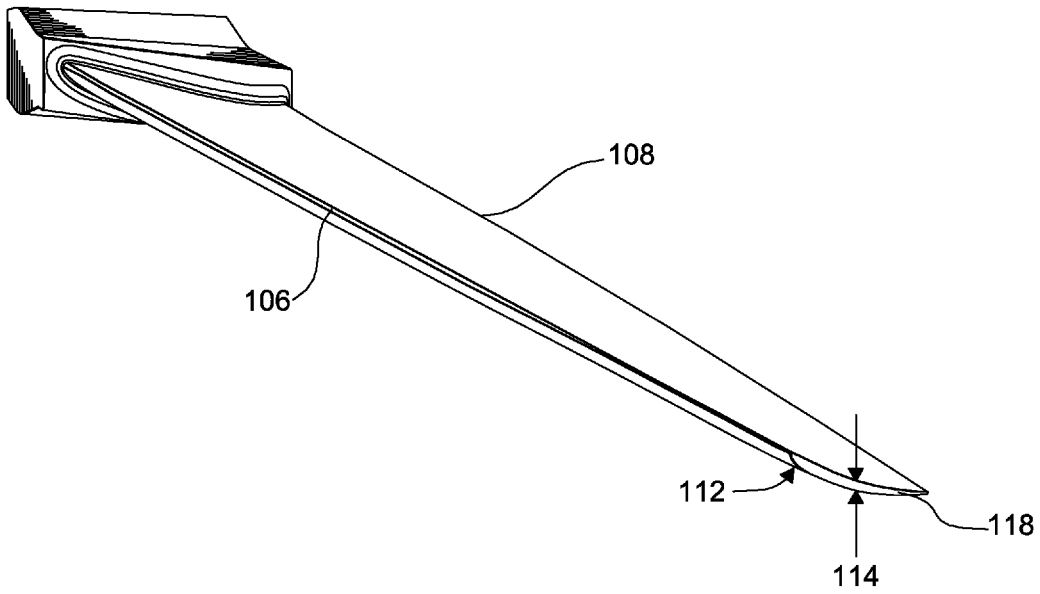
FIG. 2 is an alternate perspective view of the compressor component of FIG. 1 in accordance with an embodiment of the present invention.

Referring initially to FIGS. 1 and 2, a compressor component 100, such as a stator vane, is shown in accordance with an embodiment of the present invention. The compressor component comprises an attachment 102 and an airfoil 104 extending radially outward from the attachment 102. The airfoil 104, which can be solid or alternatively hollow, has a leading edge 106 and a trailing edge 108 spaced a distance from the leading edge 106. The airfoil 104 also has a concave surface 110 and a convex surface 112 so as to form a thickness 114 therebetween. While typically associated with a stationary component, such as a compressor vane, the present invention can also be used in conjunction with a rotating component, such as a compressor blade.

The thickness 114 varies non-linearly along an airfoil span 116 as measured in a radial direction from the attachment 102 to a tip 118 of the airfoil 104. The non-linear variation in thickness can be seen with reference to FIG. 3, in which an embodiment of the compressor component is shown including multiple span-wise cross sections comparing the prior art to the present invention. As it can be seen from FIG. 3, the thickness of an embodiment of the present invention and the prior art airfoils are similar near the attachment 102, but towards the mid-span area of the airfoil 104, the thickness 114 of the present invention airfoil is thicker than the prior art airfoil. The thickness 114 continues to vary towards the tip 118.

Figure 3:
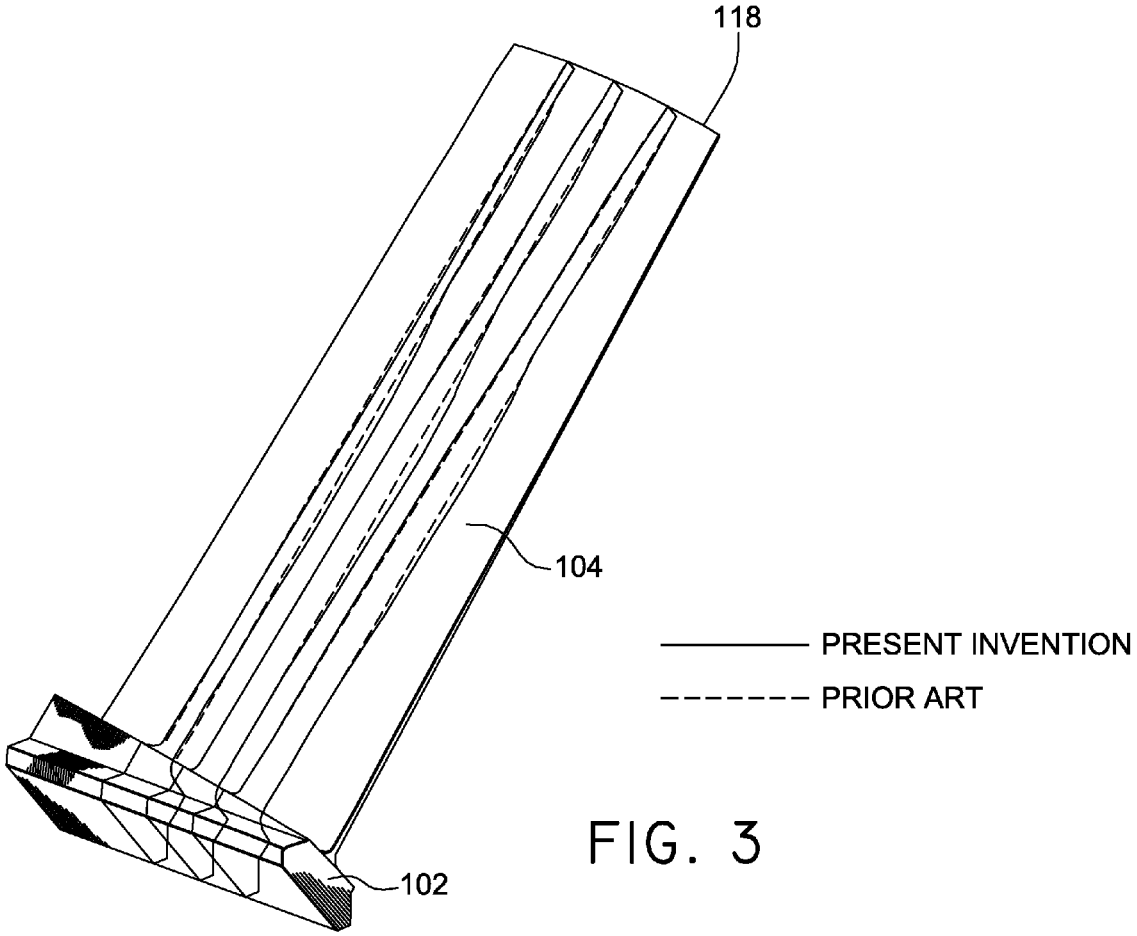
FIG. 3 is a partial cross section view of the compressor component of FIG. 1 in accordance with an embodiment of the present invention.
Figure 4:
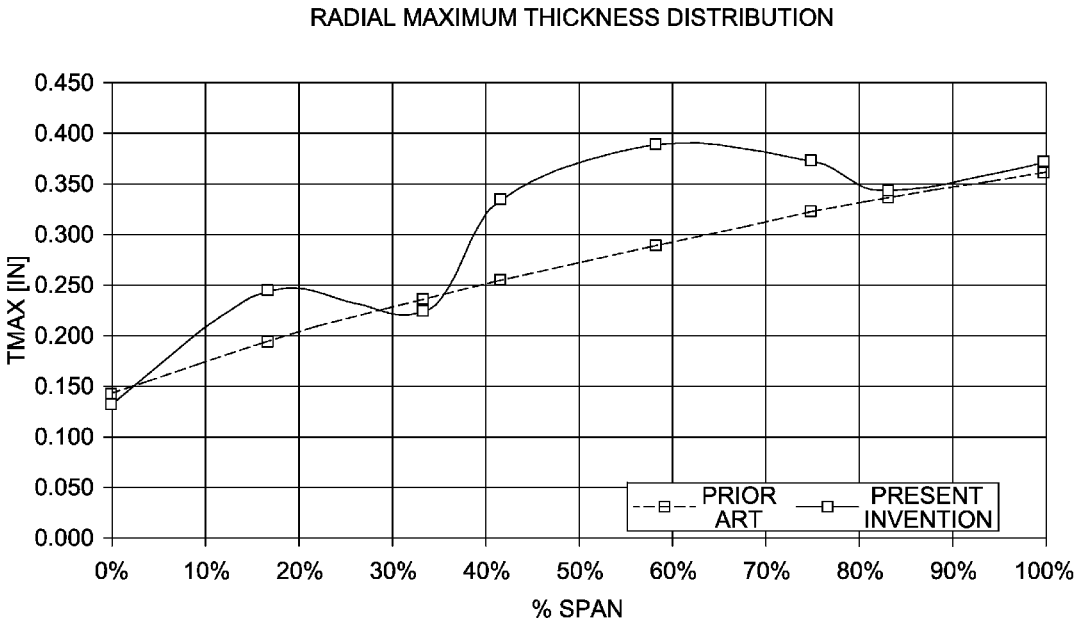
FIG. 4 is a chart depicting thickness of the airfoil as a function of percent span of the airfoil for the compressor component depicted in FIG. 1 in accordance with an embodiment of the present invention.

Referring to FIG. 4, a chart depicts the maximum thickness versus percent span of the airfoil 104 for an embodiment of the present invention compared to an airfoil of the prior art. The chart in FIG. 4 graphically depicts the variation in thickness for the airfoil 104 that is shown in FIGS. 1-3. For example, at the root of the airfoil (area adjacent the attachment), the thickness of airfoil 104 is less than that of the prior art, which is slightly less than 0.150 inches. Where the prior art airfoil increases generally linearly to the 100% span, the thickness of the present invention increases at a greater rate initially, then at approximately 20% span the thickness of the airfoil 104 decreases to approximately the 35% span, such that the thickness at approximately 15%-25% span is greater than the thickness at approximately 35% span.

From approximately 35% span until approximately 60% span, the airfoil thickness again increases non-linearly, at which point a second decrease in thickness occurs, roughly from approximately 60%-85% span. However, the thickness over at least the 40%-80% span is greater than the thickness at approximately 15%-25% span. For an embodiment of the present invention the maximum thickness of the airfoil 104 is located at approximately 60% along the span, as depicted by FIG. 4, and is approximately 0.38 inches, which is more than twice the minimum thickness of approximately 0.13 inches. As a result of the various increases and decreases in airfoil thickness, the net change results in at least a 10% increase in weight of the compressor stator.

Unlike the prior art, the maximum thickness of the airfoil 104 is not at the tip 118. In an embodiment of the present invention, the airfoil 104 has a first maximum thickness and a second maximum thickness at points along the airfoil span. As depicted in FIG. 4, the second maximum thickness is greater than the first maximum thickness with a reduction in thickness between the first maximum and second maximum thicknesses. Also, the change in thickness 114 along the airfoil 104 is non-linear.

The changes in airfoil thickness and distribution of material along the airfoil alters the natural frequency of the compressor component 100. As one skilled in the art of blade and vane airfoil design will understand, the airfoils move at various modes due to their geometry and the aerodynamic forces being applied thereto. Should this excitation occur for prolonged periods of time at a natural frequency or order thereof, the airfoil 104 can fail due to high cycle fatigue. Such modes include bending, torsion, and various higher order modes. For example, a critical bending mode for the compressor component of the present invention is the fourth bending, which is also referred to as 42E or 42 times the 60 Hz frequency of the engine. For this mode, the fourth bending results in a critical frequency of 2512 Hz. The prior art component had a higher order operating mode that corresponded to this frequency, and as such, the excitation at this frequency caused high cycle fatigue cracking at approximately 40%-60% span. Increasing the thickness of the airfoil 104 along this portion of the airfoil span, serves to alter the natural frequency of the component such that the natural frequency at this higher engine order is above the critical frequency of 2512 Hz. More specifically, the embodiment of the present invention discussed with reference to FIGS. 1-4, has the natural frequency at the fourth bending approximately 6.9% above the critical frequency of 2512 Hz, such that there was no longer a concern of excitation in the fourth bending mode causing a high cycle fatigue along the mid-span area of the airfoil. The thickness profile disclosed above and depicted in FIGS. 3 and 4 is one particular embodiment and it is within the scope of the invention to alter the location of the increase in thickness so as to alter other critical frequencies by redistributing airfoil thickness.

A compressor component for a land-based compressor is typically fabricated from a relatively low temperature alloy since air temperature of the compressor typically only reaches upwards of 700 deg. F. One such material for the compressor component 100 is a hardenable stainless steel alloy. For compressor components in this region of the engine, a common durability issue exhibited by prior art components is erosion of the airfoil leading edge. The airfoil leading edge (see 106 in FIGS. 1 and 2) is the generally radially extending edge at the forward or upstream end of the airfoil where the concave and convex surfaces come together. This edge first receives the oncoming air flow, and therefore, is also first impacted by anything entering the compressor. Over time, this leading edge can erode away and weaken the airfoil 104.

In an embodiment of the present invention, the airfoil 104 is solid and fabricated from a material such as a hardened steel alloy. The airfoil 104 has an uncoated profile substantially in accordance with Cartesian coordinate values of X and Y, for each distance Z, in inches, as set forth in Table 1 below. The distance Z is measured radially outward from a bottom surface 126 of the attachment 102. The X and Y coordinates are distances relative to coordinate plane origin established at each of the radial Z heights.

Figure 5:
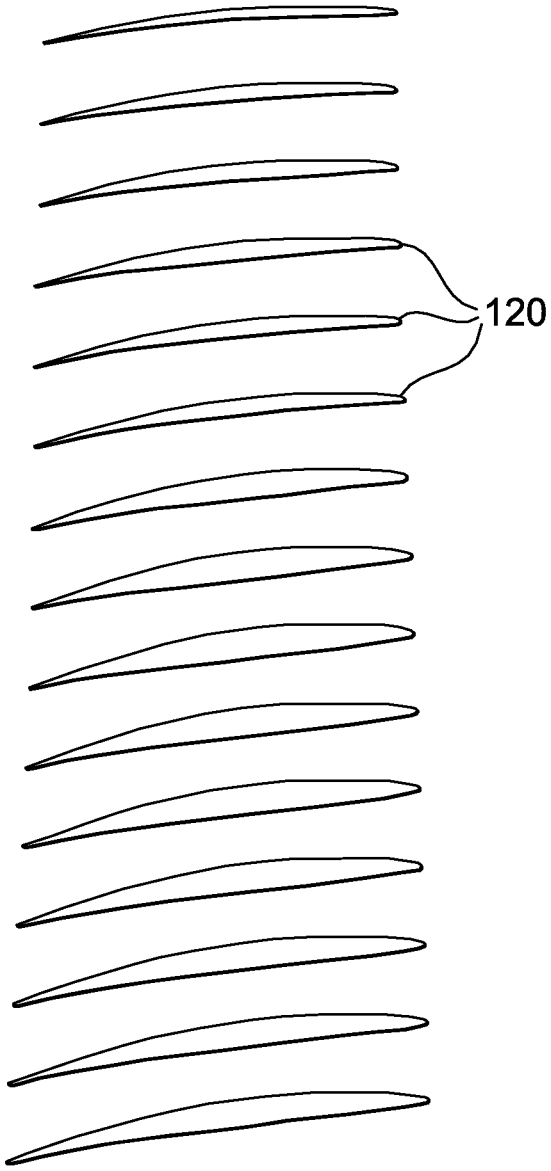
FIG. 5 is a perspective view of a series airfoil sections formed from the data in Table 1 in accordance with an embodiment of the present invention; and, FIG. 6 is a perspective view of a compressor component positioned within a portion of a carrier in accordance with an alternate embodiment of the present invention.

Referring to FIG. 5, a plurality of airfoil sections 120 are established by applying smooth continuing splines between the X and Y coordinate values at each Z distance. Then, each of the airfoil sections 120 are joined together smoothly to form the profile of the airfoil 104.

The airfoil 104 can be fabricated by a variety of manufacturing techniques such as forging, casting, milling, and electro-chemical machining (ECM). As such, the airfoil has a series of manufacturing tolerance for the position, profile, twist, and chord that can cause the airfoil 104 to vary by as much as +/−0.090 inches from a nominal state. In addition to manufacturing tolerances affecting the overall size of the airfoil 104, it is also possible to scale the airfoil 104 to a larger or smaller airfoil size. However, in order to maintain the benefits of this airfoil shape and size, in terms of stiffness and stress, it is necessary to scale the airfoil uniformly in X and Y directions, but Z direction may be scaled separately.

As previously discussed, the profile generated by the X, Y, and Z coordinates of Table 1 is an uncoated profile. While an embodiment of the present invention is an uncoated compressor component 100 such as a stator vane, it is possible to add a coating to at least a portion of the airfoil 104 in an alternate embodiment. This coating would have a thickness of up to approximately 0.010 inches

TABLE 1

| X | Y | Z |
|---|---|---|
| 0.910588 | 0.884278 | 1.5003 |
| 0.883536 | 0.881578 | 1.5003 |
| 0.856462 | 0.860372 | 1.5003 |
| 0.830451 | 0.837854 | 1.5003 |
| 0.804785 | 0.814943 | 1.5003 |
| 0.779296 | 0.791836 | 1.5003 |
| 0.753909 | 0.768616 | 1.5003 |
| 0.728579 | 0.745333 | 1.5003 |
| 0.70327 | 0.722029 | 1.5003 |
| 0.677969 | 0.698715 | 1.5003 |
| 0.652666 | 0.675403 | 1.5003 |
| 0.627354 | 0.652102 | 1.5003 |
| 0.602024 | 0.628819 | 1.5003 |
| 0.576669 | 0.605565 | 1.5003 |
| 0.551279 | 0.582348 | 1.5003 |
| 0.525847 | 0.559178 | 1.5003 |
| 0.500362 | 0.536065 | 1.5003 |
| 0.474816 | 0.51302 | 1.5003 |
| 0.449201 | 0.490052 | 1.5003 |
| 0.423512 | 0.467167 | 1.5003 |
| 0.397745 | 0.444369 | 1.5003 |
| 0.371897 | 0.421663 | 1.5003 |
| 0.345966 | 0.399053 | 1.5003 |
| 0.31995 | 0.37654 | 1.5003 |
| 0.293848 | 0.354127 | 1.5003 |
| 0.267664 | 0.331809 | 1.5003 |
| 0.241403 | 0.309582 | 1.5003 |
| 0.215069 | 0.287443 | 1.5003 |
| 0.188665 | 0.265386 | 1.5003 |
| 0.162194 | 0.243409 | 1.5003 |
| 0.135661 | 0.221509 | 1.5003 |
| 0.109067 | 0.199682 | 1.5003 |
| 0.082415 | 0.177925 | 1.5003 |
| 0.05571 | 0.156234 | 1.5003 |
| 0.028954 | 0.134605 | 1.5003 |
| 0.002147 | 0.11304 | 1.5003 |
| −0.024715 | 0.091544 | 1.5003 |
| −0.051636 | 0.070121 | 1.5003 |
| −0.078621 | 0.04878 | 1.5003 |
| −0.105678 | 0.027529 | 1.5003 |
| −0.132813 | 0.006378 | 1.5003 |
| −0.160032 | −0.014664 | 1.5003 |
| −0.187342 | −0.035589 | 1.5003 |
| −0.214746 | −0.056389 | 1.5003 |
| −0.242249 | −0.077059 | 1.5003 |
| −0.269854 | −0.097593 | 1.5003 |
| −0.297564 | −0.117985 | 1.5003 |
| −0.325381 | −0.13823 | 1.5003 |
| −0.353307 | −0.158326 | 1.5003 |
| −0.381341 | −0.17827 | 1.5003 |
| −0.409482 | −0.198062 | 1.5003 |
| −0.437728 | −0.217705 | 1.5003 |
| −0.466077 | −0.237198 | 1.5003 |
| −0.494527 | −0.256544 | 1.5003 |
| −0.523076 | −0.275743 | 1.5003 |
| −0.551725 | −0.294794 | 1.5003 |
| −0.580471 | −0.313696 | 1.5003 |
| −0.609316 | −0.332448 | 1.5003 |
| −0.638259 | −0.351049 | 1.5003 |
| −0.667302 | −0.369492 | 1.5003 |
| −0.696447 | −0.387774 | 1.5003 |
| −0.725694 | −0.405892 | 1.5003 |
| −0.755042 | −0.423847 | 1.5003 |
| −0.784487 | −0.441642 | 1.5003 |

TABLE 1-continued

| X | Y | Z |
|---|---|---|
| −0.814035 | −0.459265 | 1.5003 |
| −0.843694 | −0.476701 | 1.5003 |
| −0.873475 | −0.493928 | 1.5003 |
| −0.90339 | −0.510921 | 1.5003 |
| −0.933452 | −0.527652 | 1.5003 |
| −0.963676 | −0.544089 | 1.5003 |
| −0.994067 | −0.560216 | 1.5003 |
| −1.02462 | −0.576032 | 1.5003 |
| −1.055332 | −0.591537 | 1.5003 |
| −1.086198 | −0.606735 | 1.5003 |
| −1.11721 | −0.621632 | 1.5003 |
| −1.113241 | −0.642429 | 1.5003 |
| −1.081577 | −0.628971 | 1.5003 |
| −1.049952 | −0.615415 | 1.5003 |
| −1.018335 | −0.601842 | 1.5003 |
| −0.98673 | −0.588239 | 1.5003 |
| −0.955143 | −0.574596 | 1.5003 |
| −0.92358 | −0.560898 | 1.5003 |
| −0.892046 | −0.547132 | 1.5003 |
| −0.860548 | −0.533282 | 1.5003 |
| −0.829096 | −0.519331 | 1.5003 |
| −0.797697 | −0.50526 | 1.5003 |
| −0.766362 | −0.491047 | 1.5003 |
| −0.735102 | −0.476669 | 1.5003 |
| −0.70393 | −0.462102 | 1.5003 |
| −0.672859 | −0.447322 | 1.5003 |
| −0.641893 | −0.432321 | 1.5003 |
| −0.611034 | −0.417102 | 1.5003 |
| −0.580281 | −0.401671 | 1.5003 |
| −0.549632 | −0.386033 | 1.5003 |
| −0.519087 | −0.370194 | 1.5003 |
| −0.488644 | −0.35416 | 1.5003 |
| −0.458306 | −0.337927 | 1.5003 |
| −0.428077 | −0.321491 | 1.5003 |
| −0.397962 | −0.304849 | 1.5003 |
| −0.367964 | −0.287997 | 1.5003 |
| −0.338086 | −0.270932 | 1.5003 |
| −0.308332 | −0.253652 | 1.5003 |
| −0.278705 | −0.236156 | 1.5003 |
| −0.249206 | −0.218445 | 1.5003 |
| −0.219836 | −0.200519 | 1.5003 |
| −0.1906 | −0.182377 | 1.5003 |
| −0.161502 | −0.164014 | 1.5003 |
| −0.132548 | −0.145425 | 1.5003 |
| −0.103743 | −0.126606 | 1.5003 |
| −0.075093 | −0.107552 | 1.5003 |
| −0.046605 | −0.088256 | 1.5003 |
| −0.018288 | −0.06871 | 1.5003 |
| 0.009849 | −0.048907 | 1.5003 |
| 0.0378 | −0.028841 | 1.5003 |
| 0.065557 | −0.008508 | 1.5003 |
| 0.093115 | 0.012094 | 1.5003 |
| 0.120468 | 0.032967 | 1.5003 |
| 0.14762 | 0.054102 | 1.5003 |
| 0.174576 | 0.075485 | 1.5003 |
| 0.201348 | 0.097099 | 1.5003 |
| 0.227935 | 0.118939 | 1.5003 |
| 0.254327 | 0.141015 | 1.5003 |
| 0.280515 | 0.163332 | 1.5003 |
| 0.30649 | 0.185897 | 1.5003 |
| 0.332247 | 0.208711 | 1.5003 |
| 0.357783 | 0.231772 | 1.5003 |
| 0.383099 | 0.255074 | 1.5003 |
| 0.408203 | 0.278604 | 1.5003 |
| 0.4331 | 0.302353 | 1.5003 |
| 0.457795 | 0.326313 | 1.5003 |
| 0.48229 | 0.350476 | 1.5003 |
| 0.506587 | 0.374839 | 1.5003 |
| 0.530686 | 0.399397 | 1.5003 |
| 0.554584 | 0.424151 | 1.5003 |
| 0.578279 | 0.4491 | 1.5003 |
| 0.601765 | 0.474246 | 1.5003 |
| 0.625036 | 0.499591 | 1.5003 |
| 0.648082 | 0.52514 | 1.5003 |
| 0.670892 | 0.5509 | 1.5003 |
| 0.693453 | 0.576878 | 1.5003 |
| 0.715747 | 0.603086 | 1.5003 |
| 0.737753 | 0.629536 | 1.5003 |

TABLE 1-continued

| X | Y | Z |
|---|---|---|
| 0.759434 | 0.656254 | 1.5003 |
| 0.780746 | 0.683266 | 1.5003 |
| 0.801658 | 0.710589 | 1.5003 |
| 0.822156 | 0.738224 | 1.5003 |
| 0.842229 | 0.76617 | 1.5003 |
| 0.86182 | 0.794455 | 1.5003 |
| 0.880805 | 0.82315 | 1.5003 |
| 0.898628 | 0.852575 | 1.5003 |
| 0.94225 | 0.881792 | 2.1703 |
| 0.915422 | 0.890678 | 2.1703 |
| 0.885219 | 0.872829 | 2.1703 |
| 0.857012 | 0.851902 | 2.1703 |
| 0.829551 | 0.829998 | 2.1703 |
| 0.802265 | 0.807876 | 2.1703 |
| 0.775047 | 0.78567 | 2.1703 |
| 0.747922 | 0.76335 | 2.1703 |
| 0.720903 | 0.740904 | 2.1703 |
| 0.693969 | 0.718354 | 2.1703 |
| 0.667097 | 0.695731 | 2.1703 |
| 0.64027 | 0.673054 | 2.1703 |
| 0.613477 | 0.650337 | 2.1703 |
| 0.586709 | 0.627591 | 2.1703 |
| 0.559956 | 0.604827 | 2.1703 |
| 0.533206 | 0.58206 | 2.1703 |
| 0.50645 | 0.5593 | 2.1703 |
| 0.479675 | 0.536562 | 2.1703 |
| 0.452871 | 0.513857 | 2.1703 |
| 0.426032 | 0.491196 | 2.1703 |
| 0.399147 | 0.468588 | 2.1703 |
| 0.372209 | 0.446043 | 2.1703 |
| 0.34521 | 0.423572 | 2.1703 |
| 0.318142 | 0.401183 | 2.1703 |
| 0.291002 | 0.378882 | 2.1703 |
| 0.263791 | 0.356667 | 2.1703 |
| 0.236517 | 0.334531 | 2.1703 |
| 0.209184 | 0.312467 | 2.1703 |
| 0.1818 | 0.290466 | 2.1703 |
| 0.15437 | 0.268523 | 2.1703 |
| 0.126899 | 0.24663 | 2.1703 |
| 0.099394 | 0.224781 | 2.1703 |
| 0.071862 | 0.202967 | 2.1703 |
| 0.04431 | 0.181176 | 2.1703 |
| 0.016745 | 0.159403 | 2.1703 |
| −0.010833 | 0.137645 | 2.1703 |
| −0.038424 | 0.115905 | 2.1703 |
| −0.066031 | 0.094186 | 2.1703 |
| −0.093667 | 0.072502 | 2.1703 |
| −0.121341 | 0.050867 | 2.1703 |
| −0.149065 | 0.029296 | 2.1703 |
| −0.17685 | 0.007804 | 2.1703 |
| −0.204707 | −0.013595 | 2.1703 |
| −0.232644 | −0.034888 | 2.1703 |
| −0.260667 | −0.05607 | 2.1703 |
| −0.288775 | −0.077137 | 2.1703 |
| −0.316974 | −0.098083 | 2.1703 |
| −0.345269 | −0.118899 | 2.1703 |
| −0.37366 | −0.139585 | 2.1703 |
| −0.402142 | −0.160143 | 2.1703 |
| −0.430717 | −0.180574 | 2.1703 |
| −0.459387 | −0.200871 | 2.1703 |
| −0.488154 | −0.221028 | 2.1703 |
| −0.51702 | −0.241045 | 2.1703 |
| −0.545982 | −0.260924 | 2.1703 |
| −0.575039 | −0.280662 | 2.1703 |
| −0.604195 | −0.300253 | 2.1703 |
| −0.633453 | −0.319692 | 2.1703 |
| −0.662816 | −0.338973 | 2.1703 |
| −0.692286 | −0.358088 | 2.1703 |
| −0.721866 | −0.377034 | 2.1703 |
| −0.751561 | −0.395799 | 2.1703 |
| −0.781374 | −0.414376 | 2.1703 |
| −0.811311 | −0.432752 | 2.1703 |
| −0.841377 | −0.450917 | 2.1703 |
| −0.871576 | −0.46886 | 2.1703 |
| −0.90191 | −0.486573 | 2.1703 |
| −0.932375 | −0.504059 | 2.1703 |
| −0.962985 | −0.521291 | 2.1703 |
| −0.993775 | −0.538198 | 2.1703 |

TABLE 1-continued

| X | Y | Z |
|---|---|---|
| −1.024794 | −0.554684 | 2.1703 |
| −1.056055 | −0.570703 | 2.1703 |
| −1.087535 | −0.586288 | 2.1703 |
| −1.119197 | −0.6015 | 2.1703 |
| −1.150903 | −0.616605 | 2.1703 |
| −1.139364 | −0.636718 | 2.1703 |
| −1.106624 | −0.623893 | 2.1703 |
| −1.073868 | −0.611111 | 2.1703 |
| −1.041093 | −0.598375 | 2.1703 |
| −1.008301 | −0.585686 | 2.1703 |
| −0.97549 | −0.573045 | 2.1703 |
| −0.942661 | −0.560449 | 2.1703 |
| −0.909831 | −0.547858 | 2.1703 |
| −0.877022 | −0.535213 | 2.1703 |
| −0.844254 | −0.52246 | 2.1703 |
| −0.811546 | −0.509555 | 2.1703 |
| −0.778915 | −0.496456 | 2.1703 |
| −0.746374 | −0.483135 | 2.1703 |
| −0.713922 | −0.4696 | 2.1703 |
| −0.681555 | −0.45586 | 2.1703 |
| −0.649274 | −0.441921 | 2.1703 |
| −0.61708 | −0.427782 | 2.1703 |
| −0.584977 | −0.413439 | 2.1703 |
| −0.552971 | −0.398879 | 2.1703 |
| −0.521067 | −0.384097 | 2.1703 |
| −0.48927 | −0.369087 | 2.1703 |
| −0.457584 | −0.353844 | 2.1703 |
| −0.426012 | −0.338366 | 2.1703 |
| −0.394558 | −0.322649 | 2.1703 |
| −0.363226 | −0.306691 | 2.1703 |
| −0.332023 | −0.290483 | 2.1703 |
| −0.300953 | −0.27402 | 2.1703 |
| −0.270025 | −0.257293 | 2.1703 |
| −0.239244 | −0.240296 | 2.1703 |
| −0.208616 | −0.223026 | 2.1703 |
| −0.178146 | −0.205477 | 2.1703 |
| −0.147842 | −0.187644 | 2.1703 |
| −0.117707 | −0.169526 | 2.1703 |
| −0.087748 | −0.15112 | 2.1703 |
| −0.057969 | −0.132423 | 2.1703 |
| −0.028378 | −0.113431 | 2.1703 |
| 0.001022 | −0.094143 | 2.1703 |
| 0.030225 | −0.074559 | 2.1703 |
| 0.059225 | −0.054676 | 2.1703 |
| 0.088017 | −0.034493 | 2.1703 |
| 0.116596 | −0.014008 | 2.1703 |
| 0.144957 | 0.006776 | 2.1703 |
| 0.173098 | 0.027858 | 2.1703 |
| 0.201019 | 0.049231 | 2.1703 |
| 0.228718 | 0.070889 | 2.1703 |
| 0.256192 | 0.092833 | 2.1703 |
| 0.283433 | 0.115065 | 2.1703 |
| 0.310436 | 0.137586 | 2.1703 |
| 0.337195 | 0.160396 | 2.1703 |
| 0.363707 | 0.183493 | 2.1703 |
| 0.389971 | 0.206872 | 2.1703 |
| 0.415988 | 0.230525 | 2.1703 |
| 0.441763 | 0.254442 | 2.1703 |
| 0.467298 | 0.278615 | 2.1703 |
| 0.492594 | 0.303037 | 2.1703 |
| 0.517653 | 0.327703 | 2.1703 |
| 0.542471 | 0.352611 | 2.1703 |
| 0.567047 | 0.377758 | 2.1703 |
| 0.591376 | 0.403144 | 2.1703 |
| 0.615454 | 0.428768 | 2.1703 |
| 0.639274 | 0.454632 | 2.1703 |
| 0.662827 | 0.48074 | 2.1703 |
| 0.686098 | 0.507099 | 2.1703 |
| 0.709073 | 0.533716 | 2.1703 |
| 0.731735 | 0.560601 | 2.1703 |
| 0.754066 | 0.587762 | 2.1703 |
| 0.776044 | 0.615207 | 2.1703 |
| 0.797636 | 0.642958 | 2.1703 |
| 0.8188 | 0.671037 | 2.1703 |
| 0.839492 | 0.699466 | 2.1703 |
| 0.859661 | 0.728268 | 2.1703 |
| 0.879252 | 0.757466 | 2.1703 |
| 0.898145 | 0.787119 | 2.1703 |

TABLE 1-continued

| X | Y | Z |
|---|---|---|
| 0.916151 | 0.817319 | 2.1703 |
| 0.932846 | 0.848258 | 2.1703 |
| 0.973314 | 0.880575 | 2.8403 |
| 0.947308 | 0.895582 | 2.8403 |
| 0.9149 | 0.880572 | 2.8403 |
| 0.884968 | 0.860902 | 2.8403 |
| 0.856078 | 0.839714 | 2.8403 |
| 0.827419 | 0.818214 | 2.8403 |
| 0.79883 | 0.796619 | 2.8403 |
| 0.770365 | 0.774863 | 2.8403 |
| 0.742052 | 0.752908 | 2.8403 |
| 0.71387 | 0.730785 | 2.8403 |
| 0.685787 | 0.708538 | 2.8403 |
| 0.657782 | 0.686192 | 2.8403 |
| 0.629844 | 0.663762 | 2.8403 |
| 0.601961 | 0.641264 | 2.8403 |
| 0.574123 | 0.618711 | 2.8403 |
| 0.546317 | 0.596118 | 2.8403 |
| 0.518532 | 0.573499 | 2.8403 |
| 0.490754 | 0.550872 | 2.8403 |
| 0.462971 | 0.528249 | 2.8403 |
| 0.435173 | 0.505647 | 2.8403 |
| 0.407348 | 0.483077 | 2.8403 |
| 0.379483 | 0.460556 | 2.8403 |
| 0.351569 | 0.438097 | 2.8403 |
| 0.323594 | 0.415714 | 2.8403 |
| 0.29555 | 0.393416 | 2.8403 |
| 0.267442 | 0.371201 | 2.8403 |
| 0.239275 | 0.349059 | 2.8403 |
| 0.211057 | 0.326982 | 2.8403 |
| 0.182795 | 0.304963 | 2.8403 |
| 0.154495 | 0.282991 | 2.8403 |
| 0.126166 | 0.261058 | 2.8403 |
| 0.097814 | 0.239153 | 2.8403 |
| 0.069447 | 0.217268 | 2.8403 |
| 0.041073 | 0.195393 | 2.8403 |
| 0.0127 | 0.173516 | 2.8403 |
| −0.015664 | 0.151628 | 2.8403 |
| −0.044019 | 0.129727 | 2.8403 |
| −0.072375 | 0.107829 | 2.8403 |
| −0.100744 | 0.085946 | 2.8403 |
| −0.129136 | 0.064095 | 2.8403 |
| −0.157566 | 0.042292 | 2.8403 |
| −0.186046 | 0.020555 | 2.8403 |
| −0.214585 | −0.001106 | 2.8403 |
| −0.243191 | −0.022677 | 2.8403 |
| −0.271872 | −0.044147 | 2.8403 |
| −0.300638 | −0.065505 | 2.8403 |
| −0.329491 | −0.086745 | 2.8403 |
| −0.358427 | −0.107872 | 2.8403 |
| −0.387446 | −0.128884 | 2.8403 |
| −0.416553 | −0.149774 | 2.8403 |
| −0.445752 | −0.170536 | 2.8403 |
| −0.475043 | −0.191167 | 2.8403 |
| −0.504427 | −0.211666 | 2.8403 |
| −0.533903 | −0.232032 | 2.8403 |
| −0.563477 | −0.252256 | 2.8403 |
| −0.593152 | −0.272332 | 2.8403 |
| −0.62293 | −0.292253 | 2.8403 |
| −0.652816 | −0.312014 | 2.8403 |
| −0.682812 | −0.331605 | 2.8403 |
| −0.712924 | −0.351019 | 2.8403 |
| −0.743156 | −0.370245 | 2.8403 |
| −0.773514 | −0.389272 | 2.8403 |
| −0.804003 | −0.408088 | 2.8403 |
| −0.834629 | −0.426679 | 2.8403 |
| −0.8654 | −0.445031 | 2.8403 |
| −0.896319 | −0.463131 | 2.8403 |
| −0.927387 | −0.480975 | 2.8403 |
| −0.958601 | −0.498563 | 2.8403 |
| −0.989966 | −0.515878 | 2.8403 |
| −1.021533 | −0.532823 | 2.8403 |
| −1.053355 | −0.549285 | 2.8403 |
| −1.085442 | −0.565221 | 2.8403 |
| −1.11777 | −0.580665 | 2.8403 |
| −1.150303 | −0.595671 | 2.8403 |
| −1.181418 | −0.612527 | 2.8403 |
| −1.161684 | −0.629253 | 2.8403 |

TABLE 1-continued

| X | Y | Z |
|---|---|---|
| −1.128 | −0.617054 | 2.8403 |
| −1.094289 | −0.604928 | 2.8403 |
| −1.060544 | −0.592901 | 2.8403 |
| −1.026755 | −0.580994 | 2.8403 |
| −0.992921 | −0.569217 | 2.8403 |
| −0.959063 | −0.557511 | 2.8403 |
| −0.925207 | −0.545798 | 2.8403 |
| −0.891377 | −0.534009 | 2.8403 |
| −0.857595 | −0.522086 | 2.8403 |
| −0.823875 | −0.509985 | 2.8403 |
| −0.790226 | −0.49769 | 2.8403 |
| −0.756653 | −0.48519 | 2.8403 |
| −0.72316 | −0.472476 | 2.8403 |
| −0.689751 | −0.459542 | 2.8403 |
| −0.65643 | −0.446385 | 2.8403 |
| −0.623198 | −0.433004 | 2.8403 |
| −0.590056 | −0.419401 | 2.8403 |
| −0.557009 | −0.40557 | 2.8403 |
| −0.52406 | −0.391505 | 2.8403 |
| −0.491217 | −0.377196 | 2.8403 |
| −0.458481 | −0.362643 | 2.8403 |
| −0.425854 | −0.347848 | 2.8403 |
| −0.393338 | −0.332809 | 2.8403 |
| −0.36094 | −0.317519 | 2.8403 |
| −0.328669 | −0.301963 | 2.8403 |
| −0.296536 | −0.286123 | 2.8403 |
| −0.264551 | −0.269986 | 2.8403 |
| −0.232723 | −0.253542 | 2.8403 |
| −0.201059 | −0.236785 | 2.8403 |
| −0.169563 | −0.219714 | 2.8403 |
| −0.13824 | −0.202328 | 2.8403 |
| −0.107095 | −0.184624 | 2.8403 |
| −0.076138 | −0.166594 | 2.8403 |
| −0.045375 | −0.148235 | 2.8403 |
| −0.014815 | −0.12954 | 2.8403 |
| 0.015536 | −0.110507 | 2.8403 |
| 0.045673 | −0.091139 | 2.8403 |
| 0.075595 | −0.071438 | 2.8403 |
| 0.105296 | −0.051406 | 2.8403 |
| 0.13477 | −0.031043 | 2.8403 |
| 0.164014 | −0.01035 | 2.8403 |
| 0.193023 | 0.010672 | 2.8403 |
| 0.221791 | 0.032022 | 2.8403 |
| 0.250313 | 0.0537 | 2.8403 |
| 0.278585 | 0.075701 | 2.8403 |
| 0.306604 | 0.098025 | 2.8403 |
| 0.334365 | 0.120669 | 2.8403 |
| 0.361865 | 0.143629 | 2.8403 |
| 0.389102 | 0.166901 | 2.8403 |
| 0.416075 | 0.190477 | 2.8403 |
| 0.442784 | 0.214353 | 2.8403 |
| 0.46923 | 0.23852 | 2.8403 |
| 0.495412 | 0.262973 | 2.8403 |
| 0.521328 | 0.287706 | 2.8403 |
| 0.546977 | 0.312717 | 2.8403 |
| 0.572354 | 0.338004 | 2.8403 |
| 0.597455 | 0.363565 | 2.8403 |
| 0.622275 | 0.389398 | 2.8403 |
| 0.64681 | 0.415503 | 2.8403 |
| 0.671053 | 0.441879 | 2.8403 |
| 0.694992 | 0.468531 | 2.8403 |
| 0.718614 | 0.495465 | 2.8403 |
| 0.741901 | 0.522688 | 2.8403 |
| 0.764839 | 0.550207 | 2.8403 |
| 0.787411 | 0.578026 | 2.8403 |
| 0.809599 | 0.606152 | 2.8403 |
| 0.831368 | 0.634604 | 2.8403 |
| 0.85267 | 0.663408 | 2.8403 |
| 0.87345 | 0.692589 | 2.8403 |
| 0.893636 | 0.722185 | 2.8403 |
| 0.913146 | 0.75223 | 2.8403 |
| 0.931829 | 0.782796 | 2.8403 |
| 0.949439 | 0.813991 | 2.8403 |
| 0.965512 | 0.846001 | 2.8403 |
| 1.002988 | 0.882631 | 3.5103 |
| 0.976012 | 0.896294 | 3.5103 |
| 0.943326 | 0.880538 | 3.5103 |
| 0.913046 | 0.860388 | 3.5103 |

TABLE 1-continued

| X | Y | Z |
|---|---|---|
| 0.883663 | 0.83894 | 3.5103 |
| 0.854543 | 0.817134 | 3.5103 |
| 0.825546 | 0.795165 | 3.5103 |
| 0.796674 | 0.773032 | 3.5103 |
| 0.767926 | 0.750739 | 3.5103 |
| 0.739283 | 0.72831 | 3.5103 |
| 0.710725 | 0.705773 | 3.5103 |
| 0.682238 | 0.683148 | 3.5103 |
| 0.653809 | 0.660448 | 3.5103 |
| 0.625431 | 0.637686 | 3.5103 |
| 0.597092 | 0.614874 | 3.5103 |
| 0.568782 | 0.592027 | 3.5103 |
| 0.540487 | 0.569161 | 3.5103 |
| 0.512194 | 0.546292 | 3.5103 |
| 0.483892 | 0.523435 | 3.5103 |
| 0.455568 | 0.500605 | 3.5103 |
| 0.42721 | 0.477817 | 3.5103 |
| 0.398807 | 0.455085 | 3.5103 |
| 0.370347 | 0.432425 | 3.5103 |
| 0.341816 | 0.409855 | 3.5103 |
| 0.313208 | 0.387381 | 3.5103 |
| 0.284526 | 0.365003 | 3.5103 |
| 0.255774 | 0.342714 | 3.5103 |
| 0.22696 | 0.320506 | 3.5103 |
| 0.19809 | 0.298371 | 3.5103 |
| 0.16917 | 0.2763 | 3.5103 |
| 0.140207 | 0.254287 | 3.5103 |
| 0.111207 | 0.232322 | 3.5103 |
| 0.082175 | 0.2104 | 3.5103 |
| 0.053119 | 0.188509 | 3.5103 |
| 0.024049 | 0.166636 | 3.5103 |
| −0.005031 | 0.144778 | 3.5103 |
| −0.034127 | 0.122941 | 3.5103 |
| −0.063244 | 0.101131 | 3.5103 |
| −0.092389 | 0.079358 | 3.5103 |
| −0.121573 | 0.057639 | 3.5103 |
| −0.150805 | 0.035984 | 3.5103 |
| −0.180095 | 0.014407 | 3.5103 |
| −0.209454 | −0.007076 | 3.5103 |
| −0.23889 | −0.028453 | 3.5103 |
| −0.268409 | −0.049716 | 3.5103 |
| −0.298012 | −0.070861 | 3.5103 |
| −0.327701 | −0.091884 | 3.5103 |
| −0.357483 | −0.112777 | 3.5103 |
| −0.387359 | −0.133535 | 3.5103 |
| −0.417328 | −0.154158 | 3.5103 |
| −0.447392 | −0.174642 | 3.5103 |
| −0.477556 | −0.194979 | 3.5103 |
| −0.507825 | −0.215159 | 3.5103 |
| −0.538203 | −0.235175 | 3.5103 |
| −0.56869 | −0.255025 | 3.5103 |
| −0.599289 | −0.274701 | 3.5103 |
| −0.630004 | −0.294195 | 3.5103 |
| −0.66084 | −0.313498 | 3.5103 |
| −0.6918 | −0.332601 | 3.5103 |
| −0.722888 | −0.351495 | 3.5103 |
| −0.754107 | −0.370172 | 3.5103 |
| −0.785462 | −0.388621 | 3.5103 |
| −0.816956 | −0.40683 | 3.5103 |
| −0.848594 | −0.424787 | 3.5103 |
| −0.880379 | −0.442483 | 3.5103 |
| −0.912313 | −0.45991 | 3.5103 |
| −0.94439 | −0.477071 | 3.5103 |
| −0.976608 | −0.493967 | 3.5103 |
| −1.008972 | −0.51058 | 3.5103 |
| −1.041522 | −0.526827 | 3.5103 |
| −1.074295 | −0.542618 | 3.5103 |
| −1.107307 | −0.557903 | 3.5103 |
| −1.140551 | −0.572677 | 3.5103 |
| −1.174018 | −0.586939 | 3.5103 |
| −1.205751 | −0.603564 | 3.5103 |
| −1.186512 | −0.622775 | 3.5103 |
| −1.151989 | −0.61114 | 3.5103 |
| −1.117432 | −0.599607 | 3.5103 |
| −1.082848 | −0.588155 | 3.5103 |
| −1.048244 | −0.576764 | 3.5103 |
| −1.013625 | −0.565418 | 3.5103 |
| −0.978998 | −0.554098 | 3.5103 |

TABLE 1-continued

| X | Y | Z |
|---|---|---|
| −0.944378 | −0.542754 | 3.5103 |
| −0.909783 | −0.531333 | 3.5103 |
| −0.875231 | −0.519785 | 3.5103 |
| −0.840736 | −0.508067 | 3.5103 |
| −0.806313 | −0.496141 | 3.5103 |
| −0.771971 | −0.483983 | 3.5103 |
| −0.737709 | −0.471599 | 3.5103 |
| −0.703529 | −0.458994 | 3.5103 |
| −0.66943 | −0.446167 | 3.5103 |
| −0.635418 | −0.433114 | 3.5103 |
| −0.601498 | −0.419824 | 3.5103 |
| −0.567677 | −0.406283 | 3.5103 |
| −0.533961 | −0.392485 | 3.5103 |
| −0.500351 | −0.378428 | 3.5103 |
| −0.466852 | −0.364109 | 3.5103 |
| −0.433468 | −0.349525 | 3.5103 |
| −0.400201 | −0.334674 | 3.5103 |
| −0.367059 | −0.319549 | 3.5103 |
| −0.334046 | −0.304142 | 3.5103 |
| −0.30117 | −0.288446 | 3.5103 |
| −0.268435 | −0.272457 | 3.5103 |
| −0.235848 | −0.25617 | 3.5103 |
| −0.203412 | −0.239583 | 3.5103 |
| −0.171136 | −0.222688 | 3.5103 |
| −0.139026 | −0.205479 | 3.5103 |
| −0.10709 | −0.18795 | 3.5103 |
| −0.075335 | −0.170094 | 3.5103 |
| −0.04377 | −0.151905 | 3.5103 |
| −0.012404 | −0.133375 | 3.5103 |
| 0.018755 | −0.114497 | 3.5103 |
| 0.049696 | −0.095267 | 3.5103 |
| 0.080413 | −0.07568 | 3.5103 |
| 0.110898 | −0.055732 | 3.5103 |
| 0.141143 | −0.035424 | 3.5103 |
| 0.171143 | −0.014755 | 3.5103 |
| 0.200895 | 0.006269 | 3.5103 |
| 0.230399 | 0.02764 | 3.5103 |
| 0.259657 | 0.049346 | 3.5103 |
| 0.288666 | 0.071385 | 3.5103 |
| 0.317425 | 0.093747 | 3.5103 |
| 0.345935 | 0.116427 | 3.5103 |
| 0.374193 | 0.139421 | 3.5103 |
| 0.402195 | 0.162725 | 3.5103 |
| 0.429938 | 0.186336 | 3.5103 |
| 0.457417 | 0.210255 | 3.5103 |
| 0.484627 | 0.23448 | 3.5103 |
| 0.51156 | 0.259011 | 3.5103 |
| 0.538213 | 0.283847 | 3.5103 |
| 0.564579 | 0.308987 | 3.5103 |
| 0.590655 | 0.334428 | 3.5103 |
| 0.616436 | 0.360168 | 3.5103 |
| 0.641918 | 0.386203 | 3.5103 |
| 0.667098 | 0.412531 | 3.5103 |
| 0.691975 | 0.439146 | 3.5103 |
| 0.716539 | 0.466049 | 3.5103 |
| 0.740781 | 0.493243 | 3.5103 |
| 0.764687 | 0.520733 | 3.5103 |
| 0.788244 | 0.548523 | 3.5103 |
| 0.811441 | 0.576613 | 3.5103 |
| 0.83426 | 0.605012 | 3.5103 |
| 0.856658 | 0.633743 | 3.5103 |
| 0.878579 | 0.662841 | 3.5103 |
| 0.899964 | 0.692334 | 3.5103 |
| 0.920736 | 0.722262 | 3.5103 |
| 0.940819 | 0.752656 | 3.5103 |
| 0.960097 | 0.783567 | 3.5103 |
| 0.978329 | 0.815105 | 3.5103 |
| 0.994892 | 0.847544 | 3.5103 |
| 1.031963 | 0.886474 | 4.1803 |
| 1.003338 | 0.894673 | 4.1803 |
| 0.971355 | 0.876373 | 4.1803 |
| 0.941324 | 0.854916 | 4.1803 |
| 0.911851 | 0.832695 | 4.1803 |
| 0.88268 | 0.810079 | 4.1803 |
| 0.853701 | 0.787218 | 4.1803 |
| 0.824837 | 0.764211 | 4.1803 |
| 0.796033 | 0.741129 | 4.1803 |
| 0.767275 | 0.71799 | 4.1803 |

TABLE 1-continued

| X | Y | Z |
|---|---|---|
| 0.738557 | 0.694802 | 4.1803 |
| 0.709874 | 0.67157 | 4.1803 |
| 0.681217 | 0.648305 | 4.1803 |
| 0.652579 | 0.625018 | 4.1803 |
| 0.623952 | 0.601717 | 4.1803 |
| 0.595324 | 0.578416 | 4.1803 |
| 0.566685 | 0.55513 | 4.1803 |
| 0.538022 | 0.531874 | 4.1803 |
| 0.509322 | 0.508663 | 4.1803 |
| 0.480576 | 0.485509 | 4.1803 |
| 0.451773 | 0.462426 | 4.1803 |
| 0.422905 | 0.439425 | 4.1803 |
| 0.39396 | 0.416519 | 4.1803 |
| 0.364929 | 0.393724 | 4.1803 |
| 0.335805 | 0.371048 | 4.1803 |
| 0.30659 | 0.348488 | 4.1803 |
| 0.27729 | 0.326039 | 4.1803 |
| 0.24791 | 0.303694 | 4.1803 |
| 0.218456 | 0.281449 | 4.1803 |
| 0.18893 | 0.259298 | 4.1803 |
| 0.159338 | 0.237236 | 4.1803 |
| 0.129683 | 0.215258 | 4.1803 |
| 0.099971 | 0.193357 | 4.1803 |
| 0.070206 | 0.171529 | 4.1803 |
| 0.040391 | 0.149768 | 4.1803 |
| 0.010529 | 0.128072 | 4.1803 |
| −0.019379 | 0.10644 | 4.1803 |
| −0.049338 | 0.084879 | 4.1803 |
| −0.079357 | 0.0634 | 4.1803 |
| −0.109439 | 0.042012 | 4.1803 |
| −0.139592 | 0.020722 | 4.1803 |
| −0.16982 | −0.00046 | 4.1803 |
| −0.200129 | −0.021527 | 4.1803 |
| −0.230524 | −0.04247 | 4.1803 |
| −0.26101 | −0.06328 | 4.1803 |
| −0.29159 | −0.08395 | 4.1803 |
| −0.322267 | −0.104478 | 4.1803 |
| −0.353043 | −0.124856 | 4.1803 |
| −0.383923 | −0.145077 | 4.1803 |
| −0.414912 | −0.16513 | 4.1803 |
| −0.446014 | −0.185007 | 4.1803 |
| −0.477228 | −0.204707 | 4.1803 |
| −0.508555 | −0.224228 | 4.1803 |
| −0.54 | −0.243559 | 4.1803 |
| −0.57157 | −0.262684 | 4.1803 |
| −0.603269 | −0.281594 | 4.1803 |
| −0.635098 | −0.300286 | 4.1803 |
| −0.667055 | −0.318757 | 4.1803 |
| −0.69914 | −0.337005 | 4.1803 |
| −0.731356 | −0.355021 | 4.1803 |
| −0.763703 | −0.3728 | 4.1803 |
| −0.796181 | −0.390339 | 4.1803 |
| −0.828792 | −0.40763 | 4.1803 |
| −0.861536 | −0.424668 | 4.1803 |
| −0.894413 | −0.441445 | 4.1803 |
| −0.927424 | −0.45796 | 4.1803 |
| −0.960566 | −0.47421 | 4.1803 |
| −0.993842 | −0.490182 | 4.1803 |
| −1.027264 | −0.505849 | 4.1803 |
| −1.060844 | −0.521172 | 4.1803 |
| −1.094601 | −0.536101 | 4.1803 |
| −1.128556 | −0.550573 | 4.1803 |
| −1.162731 | −0.56452 | 4.1803 |
| −1.197132 | −0.577898 | 4.1803 |
| −1.228075 | −0.595644 | 4.1803 |
| −1.205828 | −0.613648 | 4.1803 |
| −1.17066 | −0.602469 | 4.1803 |
| −1.135457 | −0.5914 | 4.1803 |
| −1.10023 | −0.580408 | 4.1803 |
| −1.064992 | −0.569454 | 4.1803 |
| −1.029754 | −0.558496 | 4.1803 |
| −0.994532 | −0.547488 | 4.1803 |
| −0.959342 | −0.536378 | 4.1803 |
| −0.924198 | −0.525126 | 4.1803 |
| −0.889104 | −0.513714 | 4.1803 |
| −0.854068 | −0.502129 | 4.1803 |
| −0.819095 | −0.490354 | 4.1803 |
| −0.784192 | −0.478372 | 4.1803 |

TABLE 1-continued

| X | Y | Z |
|---|---|---|
| −0.749367 | −0.466167 | 4.1803 |
| −0.714627 | −0.453722 | 4.1803 |
| −0.679976 | −0.441031 | 4.1803 |
| −0.645419 | −0.428086 | 4.1803 |
| −0.610961 | −0.41488 | 4.1803 |
| −0.576606 | −0.401406 | 4.1803 |
| −0.542361 | −0.387658 | 4.1803 |
| −0.50823 | −0.373629 | 4.1803 |
| −0.474216 | −0.359318 | 4.1803 |
| −0.440323 | −0.344721 | 4.1803 |
| −0.406556 | −0.329837 | 4.1803 |
| −0.372918 | −0.314664 | 4.1803 |
| −0.339412 | −0.299201 | 4.1803 |
| −0.306041 | −0.283449 | 4.1803 |
| −0.272808 | −0.267408 | 4.1803 |
| −0.239714 | −0.251081 | 4.1803 |
| −0.206763 | −0.234468 | 4.1803 |
| −0.17396 | −0.217565 | 4.1803 |
| −0.14131 | −0.200368 | 4.1803 |
| −0.108818 | −0.182874 | 4.1803 |
| −0.076491 | −0.165077 | 4.1803 |
| −0.04434 | −0.146964 | 4.1803 |
| −0.012377 | −0.128522 | 4.1803 |
| 0.019385 | −0.109736 | 4.1803 |
| 0.050933 | −0.090592 | 4.1803 |
| 0.082252 | −0.071077 | 4.1803 |
| 0.113328 | −0.051176 | 4.1803 |
| 0.144148 | −0.030882 | 4.1803 |
| 0.174714 | −0.010206 | 4.1803 |
| 0.205026 | 0.010839 | 4.1803 |
| 0.235092 | 0.032235 | 4.1803 |
| 0.264914 | 0.05397 | 4.1803 |
| 0.2945 | 0.076026 | 4.1803 |
| 0.323852 | 0.09839 | 4.1803 |
| 0.352971 | 0.121058 | 4.1803 |
| 0.381856 | 0.144023 | 4.1803 |
| 0.410504 | 0.167284 | 4.1803 |
| 0.438909 | 0.190841 | 4.1803 |
| 0.467064 | 0.214695 | 4.1803 |
| 0.494958 | 0.238855 | 4.1803 |
| 0.522579 | 0.263325 | 4.1803 |
| 0.549919 | 0.288111 | 4.1803 |
| 0.576968 | 0.313212 | 4.1803 |
| 0.603724 | 0.338626 | 4.1803 |
| 0.63018 | 0.364351 | 4.1803 |
| 0.656336 | 0.390383 | 4.1803 |
| 0.68219 | 0.416714 | 4.1803 |
| 0.707741 | 0.443339 | 4.1803 |
| 0.73299 | 0.47025 | 4.1803 |
| 0.757931 | 0.497447 | 4.1803 |
| 0.782556 | 0.524931 | 4.1803 |
| 0.806856 | 0.552703 | 4.1803 |
| 0.830822 | 0.580763 | 4.1803 |
| 0.854438 | 0.609119 | 4.1803 |
| 0.877648 | 0.637807 | 4.1803 |
| 0.900381 | 0.666875 | 4.1803 |
| 0.922576 | 0.696355 | 4.1803 |
| 0.944171 | 0.726278 | 4.1803 |
| 0.965113 | 0.756661 | 4.1803 |
| 0.985367 | 0.787507 | 4.1803 |
| 1.004765 | 0.818898 | 4.1803 |
| 1.022395 | 0.851305 | 4.1803 |
| 1.062478 | 0.887 | 4.8503 |
| 1.034107 | 0.89766 | 4.8503 |
| 1.001271 | 0.879914 | 4.8503 |
| 0.970438 | 0.858758 | 4.8503 |
| 0.94014 | 0.836839 | 4.8503 |
| 0.910171 | 0.814471 | 4.8503 |
| 0.88043 | 0.791801 | 4.8503 |
| 0.850837 | 0.768939 | 4.8503 |
| 0.821324 | 0.745972 | 4.8503 |
| 0.791863 | 0.72294 | 4.8503 |
| 0.762431 | 0.69987 | 4.8503 |
| 0.733013 | 0.676782 | 4.8503 |
| 0.703601 | 0.653687 | 4.8503 |
| 0.674189 | 0.630591 | 4.8503 |
| 0.644771 | 0.607504 | 4.8503 |
| 0.615338 | 0.584435 | 4.8503 |

TABLE 1-continued

| X | Y | Z |
|---|---|---|
| 0.585878 | 0.5614 | 4.8503 |
| 0.556381 | 0.538415 | 4.8503 |
| 0.526834 | 0.515492 | 4.8503 |
| 0.497232 | 0.49264 | 4.8503 |
| 0.467569 | 0.469868 | 4.8503 |
| 0.437839 | 0.447184 | 4.8503 |
| 0.408035 | 0.424597 | 4.8503 |
| 0.37815 | 0.402117 | 4.8503 |
| 0.348182 | 0.379748 | 4.8503 |
| 0.318136 | 0.357483 | 4.8503 |
| 0.288018 | 0.335317 | 4.8503 |
| 0.257834 | 0.31324 | 4.8503 |
| 0.227587 | 0.291249 | 4.8503 |
| 0.197283 | 0.269338 | 4.8503 |
| 0.166922 | 0.247504 | 4.8503 |
| 0.136509 | 0.225744 | 4.8503 |
| 0.106048 | 0.204052 | 4.8503 |
| 0.075543 | 0.18242 | 4.8503 |
| 0.044998 | 0.160846 | 4.8503 |
| 0.014411 | 0.139331 | 4.8503 |
| −0.016219 | 0.117877 | 4.8503 |
| −0.046894 | 0.096487 | 4.8503 |
| −0.077619 | 0.07517 | 4.8503 |
| −0.1084 | 0.053933 | 4.8503 |
| −0.139241 | 0.032784 | 4.8503 |
| −0.170146 | 0.011729 | 4.8503 |
| −0.201122 | −0.009223 | 4.8503 |
| −0.23217 | −0.030067 | 4.8503 |
| −0.263295 | −0.050796 | 4.8503 |
| −0.294502 | −0.071402 | 4.8503 |
| −0.325795 | −0.091876 | 4.8503 |
| −0.357179 | −0.112211 | 4.8503 |
| −0.388657 | −0.1324 | 4.8503 |
| −0.420235 | −0.152432 | 4.8503 |
| −0.451918 | −0.172297 | 4.8503 |
| −0.483711 | −0.191986 | 4.8503 |
| −0.515617 | −0.211492 | 4.8503 |
| −0.54764 | −0.230806 | 4.8503 |
| −0.579781 | −0.249921 | 4.8503 |
| −0.612044 | −0.26883 | 4.8503 |
| −0.644429 | −0.287529 | 4.8503 |
| −0.676937 | −0.306015 | 4.8503 |
| −0.709565 | −0.324286 | 4.8503 |
| −0.742312 | −0.342345 | 4.8503 |
| −0.775174 | −0.360193 | 4.8503 |
| −0.808149 | −0.377831 | 4.8503 |
| −0.841235 | −0.39526 | 4.8503 |
| −0.87444 | −0.412462 | 4.8503 |
| −0.907775 | −0.429409 | 4.8503 |
| −0.94125 | −0.44608 | 4.8503 |
| −0.974871 | −0.462454 | 4.8503 |
| −1.008641 | −0.478516 | 4.8503 |
| −1.042567 | −0.494248 | 4.8503 |
| −1.076666 | −0.509602 | 4.8503 |
| −1.110955 | −0.524526 | 4.8503 |
| −1.145449 | −0.538969 | 4.8503 |
| −1.180158 | −0.552888 | 4.8503 |
| −1.215089 | −0.566241 | 4.8503 |
| −1.245767 | −0.584795 | 4.8503 |
| −1.221223 | −0.600886 | 4.8503 |
| −1.185449 | −0.590052 | 4.8503 |
| −1.149619 | −0.579404 | 4.8503 |
| −1.113748 | −0.568896 | 4.8503 |
| −1.077851 | −0.558475 | 4.8503 |
| −1.041946 | −0.548083 | 4.8503 |
| −1.006051 | −0.537657 | 4.8503 |
| −0.970186 | −0.52713 | 4.8503 |
| −0.934362 | −0.51646 | 4.8503 |
| −0.898586 | −0.505631 | 4.8503 |
| −0.862864 | −0.494628 | 4.8503 |
| −0.827201 | −0.483434 | 4.8503 |
| −0.791604 | −0.47203 | 4.8503 |
| −0.756082 | −0.460397 | 4.8503 |
| −0.72064 | −0.448522 | 4.8503 |
| −0.685284 | −0.436393 | 4.8503 |
| −0.65002 | −0.423998 | 4.8503 |
| −0.614855 | −0.411324 | 4.8503 |
| −0.579797 | −0.398359 | 4.8503 |

TABLE 1-continued

| X | Y | Z |
|---|---|---|
| −0.544852 | −0.385093 | 4.8503 |
| −0.510024 | −0.371522 | 4.8503 |
| −0.475316 | −0.357648 | 4.8503 |
| −0.44073 | −0.34347 | 4.8503 |
| −0.40627 | −0.328992 | 4.8503 |
| −0.371937 | −0.314213 | 4.8503 |
| −0.337735 | −0.299134 | 4.8503 |
| −0.303667 | −0.283754 | 4.8503 |
| −0.269736 | −0.268075 | 4.8503 |
| −0.235944 | −0.252098 | 4.8503 |
| −0.202296 | −0.23582 | 4.8503 |
| −0.168797 | −0.219236 | 4.8503 |
| −0.135454 | −0.202343 | 4.8503 |
| −0.102272 | −0.185135 | 4.8503 |
| −0.069261 | −0.167602 | 4.8503 |
| −0.036432 | −0.14973 | 4.8503 |
| −0.003799 | −0.131502 | 4.8503 |
| 0.028625 | −0.112905 | 4.8503 |
| 0.060826 | −0.093924 | 4.8503 |
| 0.092789 | −0.074546 | 4.8503 |
| 0.1245 | −0.054758 | 4.8503 |
| 0.155952 | −0.034561 | 4.8503 |
| 0.187144 | −0.013966 | 4.8503 |
| 0.21808 | 0.007014 | 4.8503 |
| 0.248762 | 0.028363 | 4.8503 |
| 0.279194 | 0.050066 | 4.8503 |
| 0.309384 | 0.072105 | 4.8503 |
| 0.339331 | 0.094473 | 4.8503 |
| 0.369034 | 0.117164 | 4.8503 |
| 0.398491 | 0.140174 | 4.8503 |
| 0.4277 | 0.163498 | 4.8503 |
| 0.456658 | 0.187132 | 4.8503 |
| 0.48536 | 0.211076 | 4.8503 |
| 0.513799 | 0.235333 | 4.8503 |
| 0.541968 | 0.259903 | 4.8503 |
| 0.569858 | 0.284788 | 4.8503 |
| 0.597464 | 0.309988 | 4.8503 |
| 0.62478 | 0.335503 | 4.8503 |
| 0.651801 | 0.361329 | 4.8503 |
| 0.678523 | 0.387465 | 4.8503 |
| 0.704942 | 0.413907 | 4.8503 |
| 0.731056 | 0.44065 | 4.8503 |
| 0.756862 | 0.467692 | 4.8503 |
| 0.782354 | 0.495028 | 4.8503 |
| 0.807524 | 0.522662 | 4.8503 |
| 0.832363 | 0.550594 | 4.8503 |
| 0.856858 | 0.578828 | 4.8503 |
| 0.88099 | 0.607372 | 4.8503 |
| 0.9047 | 0.636267 | 4.8503 |
| 0.927912 | 0.665565 | 4.8503 |
| 0.950562 | 0.695298 | 4.8503 |
| 0.97261 | 0.725482 | 4.8503 |
| 0.99402 | 0.75612 | 4.8503 |
| 1.014782 | 0.787201 | 4.8503 |
| 1.034674 | 0.818844 | 4.8503 |
| 1.052473 | 0.851699 | 4.8503 |
| 1.095928 | 0.881196 | 5.5203 |
| 1.072863 | 0.905997 | 5.5203 |
| 1.036237 | 0.897324 | 5.5203 |
| 1.002319 | 0.880335 | 5.5203 |
| 0.969594 | 0.861121 | 5.5203 |
| 0.937329 | 0.841139 | 5.5203 |
| 0.905266 | 0.820835 | 5.5203 |
| 0.873428 | 0.800181 | 5.5203 |
| 0.841838 | 0.779149 | 5.5203 |
| 0.810452 | 0.757814 | 5.5203 |
| 0.779179 | 0.736313 | 5.5203 |
| 0.747964 | 0.714727 | 5.5203 |
| 0.716792 | 0.693079 | 5.5203 |
| 0.685658 | 0.671378 | 5.5203 |
| 0.654552 | 0.649635 | 5.5203 |
| 0.623467 | 0.627864 | 5.5203 |
| 0.59239 | 0.60608 | 5.5203 |
| 0.56131 | 0.584301 | 5.5203 |
| 0.530219 | 0.562537 | 5.5203 |
| 0.499113 | 0.540795 | 5.5203 |
| 0.467989 | 0.519079 | 5.5203 |
| 0.436843 | 0.497394 | 5.5203 |

TABLE 1-continued

| X | Y | Z |
|---|---|---|
| 0.405671 | 0.475747 | 5.5203 |
| 0.374471 | 0.45414 | 5.5203 |
| 0.343242 | 0.432574 | 5.5203 |
| 0.311991 | 0.411042 | 5.5203 |
| 0.280727 | 0.389528 | 5.5203 |
| 0.249458 | 0.368021 | 5.5203 |
| 0.218189 | 0.346513 | 5.5203 |
| 0.186924 | 0.325001 | 5.5203 |
| 0.155666 | 0.303478 | 5.5203 |
| 0.124418 | 0.28194 | 5.5203 |
| 0.093185 | 0.260382 | 5.5203 |
| 0.06197 | 0.238796 | 5.5203 |
| 0.030781 | 0.217173 | 5.5203 |
| −0.000382 | 0.195514 | 5.5203 |
| −0.031526 | 0.173826 | 5.5203 |
| −0.062657 | 0.152119 | 5.5203 |
| −0.093782 | 0.130404 | 5.5203 |
| −0.124908 | 0.10869 | 5.5203 |
| −0.156042 | 0.086989 | 5.5203 |
| −0.187192 | 0.065309 | 5.5203 |
| −0.218363 | 0.043661 | 5.5203 |
| −0.249564 | 0.022055 | 5.5203 |
| −0.280799 | 0.000499 | 5.5203 |
| −0.312075 | −0.020998 | 5.5203 |
| −0.3434 | −0.042423 | 5.5203 |
| −0.37478 | −0.063767 | 5.5203 |
| −0.406222 | −0.08502 | 5.5203 |
| −0.437733 | −0.106171 | 5.5203 |
| −0.469322 | −0.127206 | 5.5203 |
| −0.500995 | −0.148113 | 5.5203 |
| −0.53276 | −0.16888 | 5.5203 |
| −0.564622 | −0.189499 | 5.5203 |
| −0.596587 | −0.209957 | 5.5203 |
| −0.62866 | −0.230246 | 5.5203 |
| −0.660844 | −0.250357 | 5.5203 |
| −0.693143 | −0.270284 | 5.5203 |
| −0.725555 | −0.290026 | 5.5203 |
| −0.758076 | −0.309589 | 5.5203 |
| −0.7907 | −0.328979 | 5.5203 |
| −0.823423 | −0.348201 | 5.5203 |
| −0.856241 | −0.367262 | 5.5203 |
| −0.889166 | −0.386136 | 5.5203 |
| −0.922232 | −0.404762 | 5.5203 |
| −0.955469 | −0.423082 | 5.5203 |
| −0.9889 | −0.441044 | 5.5203 |
| −1.022543 | −0.458607 | 5.5203 |
| −1.056411 | −0.475732 | 5.5203 |
| −1.090516 | −0.492379 | 5.5203 |
| −1.124871 | −0.508504 | 5.5203 |
| −1.159484 | −0.524068 | 5.5203 |
| −1.194359 | −0.539037 | 5.5203 |
| −1.229498 | −0.553376 | 5.5203 |
| −1.260005 | −0.572934 | 5.5203 |
| −1.232642 | −0.585538 | 5.5203 |
| −1.196189 | −0.575027 | 5.5203 |
| −1.159638 | −0.56486 | 5.5203 |
| −1.123009 | −0.554978 | 5.5203 |
| −1.086322 | −0.545314 | 5.5203 |
| −1.049597 | −0.535795 | 5.5203 |
| −1.012855 | −0.526341 | 5.5203 |
| −0.976119 | −0.516865 | 5.5203 |
| −0.939409 | −0.507291 | 5.5203 |
| −0.902731 | −0.497593 | 5.5203 |
| −0.866091 | −0.487749 | 5.5203 |
| −0.829498 | −0.477736 | 5.5203 |
| −0.792958 | −0.46753 | 5.5203 |
| −0.756481 | −0.457103 | 5.5203 |
| −0.720074 | −0.44643 | 5.5203 |
| −0.683746 | −0.435494 | 5.5203 |
| −0.647501 | −0.424285 | 5.5203 |
| −0.611345 | −0.412794 | 5.5203 |
| −0.575284 | −0.401008 | 5.5203 |
| −0.539324 | −0.388915 | 5.5203 |
| −0.503472 | −0.376508 | 5.5203 |
| −0.46773 | −0.363786 | 5.5203 |
| −0.432101 | −0.350751 | 5.5203 |
| −0.396586 | −0.337408 | 5.5203 |
| −0.361187 | −0.323762 | 5.5203 |

TABLE 1-continued

| X | Y | Z |
|---|---|---|
| −0.325904 | −0.309817 | 5.5203 |
| −0.290745 | −0.295564 | 5.5203 |
| −0.255718 | −0.280989 | 5.5203 |
| −0.220833 | −0.266077 | 5.5203 |
| −0.1861 | −0.250814 | 5.5203 |
| −0.151532 | −0.235182 | 5.5203 |
| −0.11714 | −0.219167 | 5.5203 |
| −0.082937 | −0.20275 | 5.5203 |
| −0.048939 | −0.185913 | 5.5203 |
| −0.015161 | −0.16864 | 5.5203 |
| 0.018386 | −0.150923 | 5.5203 |
| 0.051694 | −0.132759 | 5.5203 |
| 0.084754 | −0.114149 | 5.5203 |
| 0.117559 | −0.095094 | 5.5203 |
| 0.150109 | −0.075603 | 5.5203 |
| 0.182403 | −0.055694 | 5.5203 |
| 0.214447 | −0.035383 | 5.5203 |
| 0.246239 | −0.014681 | 5.5203 |
| 0.277772 | 0.006414 | 5.5203 |
| 0.309039 | 0.0279 | 5.5203 |
| 0.340033 | 0.049779 | 5.5203 |
| 0.37074 | 0.072059 | 5.5203 |
| 0.401148 | 0.094746 | 5.5203 |
| 0.431247 | 0.11784 | 5.5203 |
| 0.461037 | 0.141332 | 5.5203 |
| 0.490521 | 0.165206 | 5.5203 |
| 0.519706 | 0.189447 | 5.5203 |
| 0.548598 | 0.214034 | 5.5203 |
| 0.577207 | 0.238951 | 5.5203 |
| 0.605532 | 0.26419 | 5.5203 |
| 0.633571 | 0.289746 | 5.5203 |
| 0.66132 | 0.315618 | 5.5203 |
| 0.688771 | 0.341805 | 5.5203 |
| 0.715916 | 0.368309 | 5.5203 |
| 0.742745 | 0.395133 | 5.5203 |
| 0.769245 | 0.422282 | 5.5203 |
| 0.795402 | 0.449761 | 5.5203 |
| 0.821201 | 0.477577 | 5.5203 |
| 0.846622 | 0.505738 | 5.5203 |
| 0.871643 | 0.534256 | 5.5203 |
| 0.896236 | 0.563144 | 5.5203 |
| 0.920368 | 0.592418 | 5.5203 |
| 0.943989 | 0.622104 | 5.5203 |
| 0.967036 | 0.65224 | 5.5203 |
| 0.989447 | 0.68285 | 5.5203 |
| 1.011186 | 0.713942 | 5.5203 |
| 1.032206 | 0.745524 | 5.5203 |
| 1.052392 | 0.777645 | 5.5203 |
| 1.07122 | 0.810576 | 5.5203 |
| 1.08753 | 0.844815 | 5.5203 |
| 1.128879 | 0.87782 | 6.1903 |
| 1.109864 | 0.90896 | 6.1903 |
| 1.071869 | 0.909667 | 6.1903 |
| 1.035506 | 0.896935 | 6.1903 |
| 1.000642 | 0.88043 | 6.1903 |
| 0.966482 | 0.862501 | 6.1903 |
| 0.932592 | 0.844064 | 6.1903 |
| 0.89899 | 0.825111 | 6.1903 |
| 0.865729 | 0.805563 | 6.1903 |
| 0.832772 | 0.785506 | 6.1903 |
| 0.800013 | 0.765128 | 6.1903 |
| 0.767372 | 0.744561 | 6.1903 |
| 0.734825 | 0.723846 | 6.1903 |
| 0.702359 | 0.703004 | 6.1903 |
| 0.669961 | 0.682057 | 6.1903 |
| 0.637618 | 0.661024 | 6.1903 |
| 0.60532 | 0.639923 | 6.1903 |
| 0.573058 | 0.618766 | 6.1903 |
| 0.540824 | 0.597567 | 6.1903 |
| 0.508614 | 0.576332 | 6.1903 |
| 0.476426 | 0.555064 | 6.1903 |
| 0.444256 | 0.533768 | 6.1903 |
| 0.412101 | 0.512449 | 6.1903 |
| 0.379958 | 0.491112 | 6.1903 |
| 0.347826 | 0.469758 | 6.1903 |
| 0.31571 | 0.448381 | 6.1903 |
| 0.283615 | 0.426972 | 6.1903 |
| 0.251546 | 0.405525 | 6.1903 |

TABLE 1-continued

| X | Y | Z |
|---|---|---|
| 0.219507 | 0.384032 | 6.1903 |
| 0.187501 | 0.36249 | 6.1903 |
| 0.155533 | 0.340893 | 6.1903 |
| 0.123604 | 0.319237 | 6.1903 |
| 0.091718 | 0.297517 | 6.1903 |
| 0.059882 | 0.275726 | 6.1903 |
| 0.028098 | 0.253858 | 6.1903 |
| −0.003633 | 0.231912 | 6.1903 |
| −0.035309 | 0.209889 | 6.1903 |
| −0.066933 | 0.18779 | 6.1903 |
| −0.09851 | 0.165624 | 6.1903 |
| −0.130049 | 0.143405 | 6.1903 |
| −0.161559 | 0.121144 | 6.1903 |
| −0.193049 | 0.098854 | 6.1903 |
| −0.22453 | 0.076553 | 6.1903 |
| −0.256013 | 0.054253 | 6.1903 |
| −0.287507 | 0.031969 | 6.1903 |
| −0.319023 | 0.009718 | 6.1903 |
| −0.350575 | −0.012484 | 6.1903 |
| −0.382172 | −0.034621 | 6.1903 |
| −0.413824 | −0.05668 | 6.1903 |
| −0.44554 | −0.078646 | 6.1903 |
| −0.477329 | −0.100506 | 6.1903 |
| −0.5092 | −0.122248 | 6.1903 |
| −0.541157 | −0.143862 | 6.1903 |
| −0.573209 | −0.165335 | 6.1903 |
| −0.605363 | −0.186655 | 6.1903 |
| −0.637626 | −0.20781 | 6.1903 |
| −0.670004 | −0.228789 | 6.1903 |
| −0.702498 | −0.249587 | 6.1903 |
| −0.735107 | −0.270204 | 6.1903 |
| −0.767826 | −0.290647 | 6.1903 |
| −0.800649 | −0.310922 | 6.1903 |
| −0.833572 | −0.331035 | 6.1903 |
| −0.866591 | −0.350989 | 6.1903 |
| −0.899733 | −0.370738 | 6.1903 |
| −0.933041 | −0.390206 | 6.1903 |
| −0.966551 | −0.409324 | 6.1903 |
| −1.000291 | −0.428033 | 6.1903 |
| −1.034283 | −0.446282 | 6.1903 |
| −1.06854 | −0.464027 | 6.1903 |
| −1.10307 | −0.481234 | 6.1903 |
| −1.13788 | −0.497869 | 6.1903 |
| −1.17297 | −0.513904 | 6.1903 |
| −1.20834 | −0.529311 | 6.1903 |
| −1.243988 | −0.544064 | 6.1903 |
| −1.274895 | −0.564004 | 6.1903 |
| −1.246784 | −0.576353 | 6.1903 |
| −1.209569 | −0.566236 | 6.1903 |
| −1.172241 | −0.556545 | 6.1903 |
| −1.134822 | −0.547213 | 6.1903 |
| −1.097332 | −0.53817 | 6.1903 |
| −1.059792 | −0.529335 | 6.1903 |
| −1.022224 | −0.520622 | 6.1903 |
| −0.98465 | −0.511935 | 6.1903 |
| −0.947092 | −0.503174 | 6.1903 |
| −0.909563 | −0.494295 | 6.1903 |
| −0.872067 | −0.485277 | 6.1903 |
| −0.83461 | −0.476097 | 6.1903 |
| −0.797199 | −0.466732 | 6.1903 |
| −0.759842 | −0.457156 | 6.1903 |
| −0.722546 | −0.44734 | 6.1903 |
| −0.685321 | −0.43726 | 6.1903 |
| −0.648172 | −0.426905 | 6.1903 |
| −0.611103 | −0.416266 | 6.1903 |
| −0.574121 | −0.405331 | 6.1903 |
| −0.53723 | −0.394092 | 6.1903 |
| −0.500436 | −0.382536 | 6.1903 |
| −0.463746 | −0.370657 | 6.1903 |
| −0.427162 | −0.358455 | 6.1903 |
| −0.390685 | −0.345935 | 6.1903 |
| −0.354319 | −0.3331 | 6.1903 |
| −0.318062 | −0.319956 | 6.1903 |
| −0.281917 | −0.306508 | 6.1903 |
| −0.245895 | −0.292736 | 6.1903 |
| −0.210009 | −0.278612 | 6.1903 |
| −0.174277 | −0.264104 | 6.1903 |
| −0.138716 | −0.249181 | 6.1903 |

TABLE 1-continued

| X | Y | Z |
|---|---|---|
| −0.103346 | −0.23381 | 6.1903 |
| −0.068181 | −0.217976 | 6.1903 |
| −0.033235 | −0.201665 | 6.1903 |
| 0.001477 | −0.184863 | 6.1903 |
| 0.035942 | −0.167557 | 6.1903 |
| 0.070149 | −0.149749 | 6.1903 |
| 0.104097 | −0.131452 | 6.1903 |
| 0.137786 | −0.112682 | 6.1903 |
| 0.17122 | −0.09346 | 6.1903 |
| 0.204396 | −0.073798 | 6.1903 |
| 0.237315 | −0.053707 | 6.1903 |
| 0.269977 | −0.033202 | 6.1903 |
| 0.30238 | −0.012289 | 6.1903 |
| 0.334507 | 0.009044 | 6.1903 |
| 0.36634 | 0.030814 | 6.1903 |
| 0.397859 | 0.053036 | 6.1903 |
| 0.42905 | 0.075716 | 6.1903 |
| 0.459903 | 0.098854 | 6.1903 |
| 0.49041 | 0.122447 | 6.1903 |
| 0.520573 | 0.146476 | 6.1903 |
| 0.550406 | 0.170916 | 6.1903 |
| 0.579919 | 0.19574 | 6.1903 |
| 0.609118 | 0.220933 | 6.1903 |
| 0.638014 | 0.246473 | 6.1903 |
| 0.666606 | 0.272353 | 6.1903 |
| 0.694889 | 0.29857 | 6.1903 |
| 0.722857 | 0.325123 | 6.1903 |
| 0.750502 | 0.352012 | 6.1903 |
| 0.777812 | 0.379242 | 6.1903 |
| 0.804772 | 0.406818 | 6.1903 |
| 0.831361 | 0.434751 | 6.1903 |
| 0.857553 | 0.463057 | 6.1903 |
| 0.883318 | 0.491753 | 6.1903 |
| 0.908621 | 0.520857 | 6.1903 |
| 0.933423 | 0.550388 | 6.1903 |
| 0.95768 | 0.580368 | 6.1903 |
| 0.981347 | 0.610817 | 6.1903 |
| 1.004373 | 0.641753 | 6.1903 |
| 1.026698 | 0.673199 | 6.1903 |
| 1.048247 | 0.70518 | 6.1903 |
| 1.068915 | 0.737738 | 6.1903 |
| 1.088501 | 0.770957 | 6.1903 |
| 1.106452 | 0.805083 | 6.1903 |
| 1.121862 | 0.840423 | 6.1903 |
| 1.159925 | 0.880328 | 6.8603 |
| 1.1413 | 0.912684 | 6.8603 |
| 1.102887 | 0.915605 | 6.8603 |
| 1.065685 | 0.90356 | 6.8603 |
| 1.029976 | 0.887451 | 6.8603 |
| 0.99496 | 0.869877 | 6.8603 |
| 0.960334 | 0.851545 | 6.8603 |
| 0.926057 | 0.832567 | 6.8603 |
| 0.89211 | 0.813006 | 6.8603 |
| 0.858442 | 0.792969 | 6.8603 |
| 0.82497 | 0.772603 | 6.8603 |
| 0.791634 | 0.752019 | 6.8603 |
| 0.758405 | 0.73126 | 6.8603 |
| 0.725266 | 0.710358 | 6.8603 |
| 0.692199 | 0.689343 | 6.8603 |
| 0.65919 | 0.668236 | 6.8603 |
| 0.626232 | 0.647051 | 6.8603 |
| 0.593317 | 0.625798 | 6.8603 |
| 0.560441 | 0.604484 | 6.8603 |
| 0.527601 | 0.583117 | 6.8603 |
| 0.494793 | 0.561698 | 6.8603 |
| 0.462016 | 0.540233 | 6.8603 |
| 0.429267 | 0.518727 | 6.8603 |
| 0.396543 | 0.497181 | 6.8603 |
| 0.363842 | 0.4756 | 6.8603 |
| 0.331163 | 0.453986 | 6.8603 |
| 0.298505 | 0.432341 | 6.8603 |
| 0.265867 | 0.410666 | 6.8603 |
| 0.233251 | 0.388956 | 6.8603 |
| 0.200662 | 0.367207 | 6.8603 |
| 0.168101 | 0.345415 | 6.8603 |
| 0.135574 | 0.323574 | 6.8603 |
| 0.103083 | 0.301678 | 6.8603 |
| 0.070632 | 0.279725 | 6.8603 |

TABLE 1-continued

| X | Y | Z |
|---|---|---|
| 0.038221 | 0.25771 | 6.8603 |
| 0.005858 | 0.235626 | 6.8603 |
| −0.026449 | 0.21346 | 6.8603 |
| −0.058694 | 0.191204 | 6.8603 |
| −0.090876 | 0.168857 | 6.8603 |
| −0.123006 | 0.146434 | 6.8603 |
| −0.155089 | 0.123947 | 6.8603 |
| −0.187138 | 0.101408 | 6.8603 |
| −0.219167 | 0.078843 | 6.8603 |
| −0.251195 | 0.056275 | 6.8603 |
| −0.283235 | 0.033725 | 6.8603 |
| −0.315303 | 0.011214 | 6.8603 |
| −0.347415 | −0.011233 | 6.8603 |
| −0.379585 | −0.033597 | 6.8603 |
| −0.411826 | −0.055858 | 6.8603 |
| −0.444147 | −0.078005 | 6.8603 |
| −0.476553 | −0.100026 | 6.8603 |
| −0.50905 | −0.121913 | 6.8603 |
| −0.541642 | −0.143657 | 6.8603 |
| −0.574335 | −0.165249 | 6.8603 |
| −0.607136 | −0.186677 | 6.8603 |
| −0.640052 | −0.207929 | 6.8603 |
| −0.673085 | −0.228997 | 6.8603 |
| −0.706241 | −0.249872 | 6.8603 |
| −0.739518 | −0.270553 | 6.8603 |
| −0.772917 | −0.291037 | 6.8603 |
| −0.806434 | −0.311326 | 6.8603 |
| −0.84007 | −0.33142 | 6.8603 |
| −0.873821 | −0.351317 | 6.8603 |
| −0.907712 | −0.370976 | 6.8603 |
| −0.94178 | −0.390326 | 6.8603 |
| −0.976057 | −0.409305 | 6.8603 |
| −1.010566 | −0.427858 | 6.8603 |
| −1.045325 | −0.445938 | 6.8603 |
| −1.080345 | −0.463506 | 6.8603 |
| −1.115635 | −0.480526 | 6.8603 |
| −1.1512 | −0.496966 | 6.8603 |
| −1.18704 | −0.512795 | 6.8603 |
| −1.223155 | −0.527986 | 6.8603 |
| −1.259542 | −0.542514 | 6.8603 |
| −1.290255 | −0.56325 | 6.8603 |
| −1.261592 | −0.576598 | 6.8603 |
| −1.223654 | −0.566776 | 6.8603 |
| −1.185606 | −0.55739 | 6.8603 |
| −1.147469 | −0.548374 | 6.8603 |
| −1.109263 | −0.539655 | 6.8603 |
| −1.071008 | −0.531153 | 6.8603 |
| −1.032724 | −0.522779 | 6.8603 |
| −0.994435 | −0.514435 | 6.8603 |
| −0.956161 | −0.506018 | 6.8603 |
| −0.917915 | −0.497476 | 6.8603 |
| −0.879702 | −0.488787 | 6.8603 |
| −0.841527 | −0.47993 | 6.8603 |
| −0.803397 | −0.470882 | 6.8603 |
| −0.76532 | −0.461618 | 6.8603 |
| −0.727302 | −0.45211 | 6.8603 |
| −0.689352 | −0.442335 | 6.8603 |
| −0.651476 | −0.432279 | 6.8603 |
| −0.613678 | −0.421933 | 6.8603 |
| −0.575963 | −0.411288 | 6.8603 |
| −0.538337 | −0.400334 | 6.8603 |
| −0.500805 | −0.389061 | 6.8603 |
| −0.463373 | −0.377461 | 6.8603 |
| −0.426044 | −0.36553 | 6.8603 |
| −0.388824 | −0.353267 | 6.8603 |
| −0.351715 | −0.340671 | 6.8603 |
| −0.314721 | −0.327743 | 6.8603 |
| −0.277844 | −0.314483 | 6.8603 |
| −0.241093 | −0.300877 | 6.8603 |
| −0.204481 | −0.286902 | 6.8603 |
| −0.168023 | −0.27253 | 6.8603 |
| −0.131736 | −0.257732 | 6.8603 |
| −0.095638 | −0.242481 | 6.8603 |
| −0.059741 | −0.226759 | 6.8603 |
| −0.02406 | −0.210555 | 6.8603 |
| 0.011395 | −0.193861 | 6.8603 |
| 0.046608 | −0.176665 | 6.8603 |
| 0.081571 | −0.158964 | 6.8603 |

TABLE 1-continued

| X | Y | Z |
|---|---|---|
| 0.116277 | −0.140764 | 6.8603 |
| 0.150722 | −0.122076 | 6.8603 |
| 0.184905 | −0.102912 | 6.8603 |
| 0.218822 | −0.083281 | 6.8603 |
| 0.252466 | −0.063187 | 6.8603 |
| 0.285834 | −0.042637 | 6.8603 |
| 0.318921 | −0.021638 | 6.8603 |
| 0.351717 | −0.000187 | 6.8603 |
| 0.38421 | 0.02172 | 6.8603 |
| 0.416388 | 0.044087 | 6.8603 |
| 0.448243 | 0.066913 | 6.8603 |
| 0.479768 | 0.090191 | 6.8603 |
| 0.510959 | 0.113915 | 6.8603 |
| 0.541815 | 0.138073 | 6.8603 |
| 0.572335 | 0.162655 | 6.8603 |
| 0.602521 | 0.187645 | 6.8603 |
| 0.632373 | 0.213033 | 6.8603 |
| 0.661894 | 0.238806 | 6.8603 |
| 0.691084 | 0.264953 | 6.8603 |
| 0.719939 | 0.291469 | 6.8603 |
| 0.748457 | 0.318347 | 6.8603 |
| 0.776631 | 0.345586 | 6.8603 |
| 0.804452 | 0.373185 | 6.8603 |
| 0.83191 | 0.401145 | 6.8603 |
| 0.858984 | 0.429477 | 6.8603 |
| 0.885641 | 0.458202 | 6.8603 |
| 0.911846 | 0.48734 | 6.8603 |
| 0.937558 | 0.516913 | 6.8603 |
| 0.962738 | 0.54694 | 6.8603 |
| 0.987345 | 0.577439 | 6.8603 |
| 1.011341 | 0.608421 | 6.8603 |
| 1.034693 | 0.639892 | 6.8603 |
| 1.057342 | 0.671871 | 6.8603 |
| 1.079162 | 0.704421 | 6.8603 |
| 1.099999 | 0.737609 | 6.8603 |
| 1.119636 | 0.77152 | 6.8603 |
| 1.137716 | 0.806282 | 6.8603 |
| 1.153257 | 0.842244 | 6.8603 |
| 1.190044 | 0.886154 | 7.5303 |
| 1.17003 | 0.918196 | 7.5303 |
| 1.130861 | 0.919649 | 7.5303 |
| 1.093391 | 0.906383 | 7.5303 |
| 1.057278 | 0.889633 | 7.5303 |
| 1.021821 | 0.87153 | 7.5303 |
| 0.986827 | 0.852546 | 7.5303 |
| 0.952206 | 0.83289 | 7.5303 |
| 0.917868 | 0.812743 | 7.5303 |
| 0.88375 | 0.792226 | 7.5303 |
| 0.849806 | 0.771422 | 7.5303 |
| 0.815999 | 0.750396 | 7.5303 |
| 0.782303 | 0.729192 | 7.5303 |
| 0.748697 | 0.707846 | 7.5303 |
| 0.715159 | 0.686394 | 7.5303 |
| 0.681673 | 0.66486 | 7.5303 |
| 0.648231 | 0.643258 | 7.5303 |
| 0.614827 | 0.621597 | 7.5303 |
| 0.581457 | 0.599884 | 7.5303 |
| 0.548117 | 0.578125 | 7.5303 |
| 0.514805 | 0.556323 | 7.5303 |
| 0.48152 | 0.534479 | 7.5303 |
| 0.448259 | 0.512599 | 7.5303 |
| 0.415022 | 0.490684 | 7.5303 |
| 0.381804 | 0.468738 | 7.5303 |
| 0.348601 | 0.446771 | 7.5303 |
| 0.315404 | 0.424795 | 7.5303 |
| 0.282211 | 0.402811 | 7.5303 |
| 0.249025 | 0.380818 | 7.5303 |
| 0.215848 | 0.358811 | 7.5303 |
| 0.182686 | 0.336782 | 7.5303 |
| 0.149544 | 0.314722 | 7.5303 |
| 0.116426 | 0.292627 | 7.5303 |
| 0.083333 | 0.270494 | 7.5303 |
| 0.050269 | 0.248318 | 7.5303 |
| 0.017248 | 0.226077 | 7.5303 |
| −0.015716 | 0.203752 | 7.5303 |
| −0.048613 | 0.181329 | 7.5303 |
| −0.081444 | 0.158809 | 7.5303 |
| −0.114214 | 0.1362 | 7.5303 |

TABLE 1-continued

| X | Y | Z |
|---|---|---|
| −0.146927 | 0.11351 | 7.5303 |
| −0.1796 | 0.090762 | 7.5303 |
| −0.212257 | 0.06799 | 7.5303 |
| −0.244919 | 0.045226 | 7.5303 |
| −0.277604 | 0.022495 | 7.5303 |
| −0.310332 | −0.000174 | 7.5303 |
| −0.343119 | −0.022758 | 7.5303 |
| −0.37598 | −0.045234 | 7.5303 |
| −0.408926 | −0.067586 | 7.5303 |
| −0.441963 | −0.089802 | 7.5303 |
| −0.475097 | −0.111873 | 7.5303 |
| −0.508332 | −0.133793 | 7.5303 |
| −0.541671 | −0.155554 | 7.5303 |
| −0.575119 | −0.177146 | 7.5303 |
| −0.608683 | −0.198559 | 7.5303 |
| −0.642366 | −0.219783 | 7.5303 |
| −0.676171 | −0.240812 | 7.5303 |
| −0.710101 | −0.261638 | 7.5303 |
| −0.744159 | −0.282256 | 7.5303 |
| −0.778345 | −0.30266 | 7.5303 |
| −0.812662 | −0.322844 | 7.5303 |
| −0.847109 | −0.342804 | 7.5303 |
| −0.88169 | −0.362532 | 7.5303 |
| −0.916425 | −0.381987 | 7.5303 |
| −0.951338 | −0.401121 | 7.5303 |
| −0.986447 | −0.419892 | 7.5303 |
| −1.021766 | −0.438264 | 7.5303 |
| −1.057304 | −0.45621 | 7.5303 |
| −1.093072 | −0.473695 | 7.5303 |
| −1.12909 | −0.490656 | 7.5303 |
| −1.16538 | −0.50703 | 7.5303 |
| −1.201953 | −0.52276 | 7.5303 |
| −1.238819 | −0.537791 | 7.5303 |
| −1.275981 | −0.552074 | 7.5303 |
| −1.304254 | −0.574927 | 7.5303 |
| −1.273799 | −0.588119 | 7.5303 |
| −1.235221 | −0.578287 | 7.5303 |
| −1.196535 | −0.56889 | 7.5303 |
| −1.157761 | −0.559859 | 7.5303 |
| −1.118921 | −0.551119 | 7.5303 |
| −1.080035 | −0.542586 | 7.5303 |
| −1.041124 | −0.534167 | 7.5303 |
| −1.00221 | −0.525762 | 7.5303 |
| −0.963315 | −0.51727 | 7.5303 |
| −0.924448 | −0.50865 | 7.5303 |
| −0.885615 | −0.499882 | 7.5303 |
| −0.84682 | −0.490943 | 7.5303 |
| −0.808071 | −0.48181 | 7.5303 |
| −0.769374 | −0.472456 | 7.5303 |
| −0.730738 | −0.462853 | 7.5303 |
| −0.69217 | −0.452982 | 7.5303 |
| −0.653675 | −0.44283 | 7.5303 |
| −0.615257 | −0.432389 | 7.5303 |
| −0.576923 | −0.421647 | 7.5303 |
| −0.538677 | −0.410594 | 7.5303 |
| −0.500525 | −0.399219 | 7.5303 |
| −0.462474 | −0.387513 | 7.5303 |
| −0.424527 | −0.375473 | 7.5303 |
| −0.38669 | −0.363092 | 7.5303 |
| −0.348967 | −0.350368 | 7.5303 |
| −0.311363 | −0.337296 | 7.5303 |
| −0.273883 | −0.323871 | 7.5303 |
| −0.236539 | −0.310076 | 7.5303 |
| −0.19934 | −0.295892 | 7.5303 |
| −0.162299 | −0.281301 | 7.5303 |
| −0.12543 | −0.266282 | 7.5303 |
| −0.088744 | −0.25082 | 7.5303 |
| −0.052252 | −0.234905 | 7.5303 |
| −0.015965 | −0.218529 | 7.5303 |
| 0.020106 | −0.201683 | 7.5303 |
| 0.05595 | −0.184358 | 7.5303 |
| 0.091555 | −0.166549 | 7.5303 |
| 0.126912 | −0.148252 | 7.5303 |
| 0.162011 | −0.129463 | 7.5303 |
| 0.196841 | −0.110181 | 7.5303 |
| 0.23139 | −0.090402 | 7.5303 |
| 0.265651 | −0.070124 | 7.5303 |
| 0.299612 | −0.04935 | 7.5303 |

TABLE 1-continued

| X | Y | Z |
|---|---|---|
| 0.333266 | −0.028084 | 7.5303 |
| 0.366609 | −0.006331 | 7.5303 |
| 0.399637 | 0.015896 | 7.5303 |
| 0.432348 | 0.038588 | 7.5303 |
| 0.46474 | 0.061732 | 7.5303 |
| 0.496816 | 0.085314 | 7.5303 |
| 0.528572 | 0.109323 | 7.5303 |
| 0.560006 | 0.133753 | 7.5303 |
| 0.591116 | 0.158594 | 7.5303 |
| 0.621895 | 0.183844 | 7.5303 |
| 0.652337 | 0.209499 | 7.5303 |
| 0.682438 | 0.235554 | 7.5303 |
| 0.712195 | 0.262001 | 7.5303 |
| 0.741605 | 0.288834 | 7.5303 |
| 0.77066 | 0.316049 | 7.5303 |
| 0.799356 | 0.343644 | 7.5303 |
| 0.827686 | 0.371614 | 7.5303 |
| 0.85564 | 0.39996 | 7.5303 |
| 0.883197 | 0.428692 | 7.5303 |
| 0.910327 | 0.457827 | 7.5303 |
| 0.936991 | 0.487389 | 7.5303 |
| 0.963155 | 0.517395 | 7.5303 |
| 0.988783 | 0.54786 | 7.5303 |
| 1.013842 | 0.578794 | 7.5303 |
| 1.038298 | 0.610207 | 7.5303 |
| 1.062126 | 0.6421 | 7.5303 |
| 1.085256 | 0.674501 | 7.5303 |
| 1.107543 | 0.707488 | 7.5303 |
| 1.12882 | 0.741134 | 7.5303 |
| 1.148872 | 0.775524 | 7.5303 |
| 1.167424 | 0.810743 | 7.5303 |
| 1.183366 | 0.847209 | 7.5303 |
| 1.219952 | 0.892976 | 8.2003 |
| 1.197911 | 0.924133 | 8.2003 |
| 1.157988 | 0.9234 | 8.2003 |
| 1.120132 | 0.909161 | 8.2003 |
| 1.083575 | 0.891773 | 8.2003 |
| 1.047711 | 0.872988 | 8.2003 |
| 1.012297 | 0.853369 | 8.2003 |
| 0.977224 | 0.833144 | 8.2003 |
| 0.942398 | 0.812498 | 8.2003 |
| 0.907769 | 0.791522 | 8.2003 |
| 0.873315 | 0.77026 | 8.2003 |
| 0.839011 | 0.748757 | 8.2003 |
| 0.80483 | 0.727059 | 8.2003 |
| 0.770745 | 0.705211 | 8.2003 |
| 0.736732 | 0.683249 | 8.2003 |
| 0.702775 | 0.661202 | 8.2003 |
| 0.668859 | 0.639093 | 8.2003 |
| 0.634973 | 0.616936 | 8.2003 |
| 0.601111 | 0.594744 | 8.2003 |
| 0.567269 | 0.572521 | 8.2003 |
| 0.533446 | 0.550268 | 8.2003 |
| 0.49964 | 0.527989 | 8.2003 |
| 0.465851 | 0.505686 | 8.2003 |
| 0.432077 | 0.48336 | 8.2003 |
| 0.398314 | 0.461017 | 8.2003 |
| 0.364555 | 0.438667 | 8.2003 |
| 0.330792 | 0.416325 | 8.2003 |
| 0.297023 | 0.393991 | 8.2003 |
| 0.263251 | 0.37166 | 8.2003 |
| 0.229483 | 0.349326 | 8.2003 |
| 0.195725 | 0.326975 | 8.2003 |
| 0.161984 | 0.304598 | 8.2003 |
| 0.128266 | 0.282188 | 8.2003 |
| 0.094574 | 0.259737 | 8.2003 |
| 0.060914 | 0.237239 | 8.2003 |
| 0.027301 | 0.214672 | 8.2003 |
| −0.00625 | 0.192011 | 8.2003 |
| −0.039726 | 0.169241 | 8.2003 |
| −0.073132 | 0.146367 | 8.2003 |
| −0.106476 | 0.123403 | 8.2003 |
| −0.139767 | 0.100363 | 8.2003 |
| −0.173024 | 0.077273 | 8.2003 |
| −0.206272 | 0.054171 | 8.2003 |
| −0.239536 | 0.031091 | 8.2003 |
| −0.272835 | 0.008063 | 8.2003 |
| −0.30619 | −0.014886 | 8.2003 |

TABLE 1-continued

| X | Y | Z |
|---|---|---|
| −0.339614 | −0.037732 | 8.2003 |
| −0.373124 | −0.060454 | 8.2003 |
| −0.406728 | −0.083035 | 8.2003 |
| −0.440433 | −0.105465 | 8.2003 |
| −0.474244 | −0.127735 | 8.2003 |
| −0.508164 | −0.14984 | 8.2003 |
| −0.542194 | −0.171774 | 8.2003 |
| −0.57634 | −0.193527 | 8.2003 |
| −0.610607 | −0.215089 | 8.2003 |
| −0.644999 | −0.236452 | 8.2003 |
| −0.679518 | −0.257608 | 8.2003 |
| −0.714166 | −0.278552 | 8.2003 |
| −0.748946 | −0.299277 | 8.2003 |
| −0.78386 | −0.319775 | 8.2003 |
| −0.818908 | −0.340042 | 8.2003 |
| −0.854093 | −0.360072 | 8.2003 |
| −0.889415 | −0.379858 | 8.2003 |
| −0.924891 | −0.399367 | 8.2003 |
| −0.960537 | −0.418565 | 8.2003 |
| −0.996365 | −0.437419 | 8.2003 |
| −1.032385 | −0.455905 | 8.2003 |
| −1.068601 | −0.474003 | 8.2003 |
| −1.105027 | −0.491675 | 8.2003 |
| −1.141701 | −0.508827 | 8.2003 |
| −1.178655 | −0.525366 | 8.2003 |
| −1.215916 | −0.541203 | 8.2003 |
| −1.253499 | −0.556259 | 8.2003 |
| −1.291414 | −0.570459 | 8.2003 |
| −1.31693 | −0.595451 | 8.2003 |
| −1.28542 | −0.609374 | 8.2003 |
| −1.246224 | −0.599235 | 8.2003 |
| −1.206918 | −0.589531 | 8.2003 |
| −1.167524 | −0.580194 | 8.2003 |
| −1.128061 | −0.571147 | 8.2003 |
| −1.088552 | −0.562307 | 8.2003 |
| −1.049018 | −0.553582 | 8.2003 |
| −1.00948 | −0.544871 | 8.2003 |
| −0.969962 | −0.53607 | 8.2003 |
| −0.930476 | −0.527128 | 8.2003 |
| −0.891026 | −0.518027 | 8.2003 |
| −0.851618 | −0.508748 | 8.2003 |
| −0.812258 | −0.499268 | 8.2003 |
| −0.772952 | −0.489564 | 8.2003 |
| −0.733708 | −0.479613 | 8.2003 |
| −0.694533 | −0.469393 | 8.2003 |
| −0.655433 | −0.458892 | 8.2003 |
| −0.616411 | −0.448104 | 8.2003 |
| −0.577472 | −0.437017 | 8.2003 |
| −0.538622 | −0.425624 | 8.2003 |
| −0.499867 | −0.413915 | 8.2003 |
| −0.461211 | −0.40188 | 8.2003 |
| −0.42266 | −0.389512 | 8.2003 |
| −0.384221 | −0.376803 | 8.2003 |
| −0.345898 | −0.363746 | 8.2003 |
| −0.307698 | −0.350334 | 8.2003 |
| −0.269628 | −0.336559 | 8.2003 |
| −0.231695 | −0.32241 | 8.2003 |
| −0.193909 | −0.307873 | 8.2003 |
| −0.15628 | −0.292934 | 8.2003 |
| −0.11882 | −0.277577 | 8.2003 |
| −0.08154 | −0.261788 | 8.2003 |
| −0.044449 | −0.245559 | 8.2003 |
| −0.007557 | −0.228883 | 8.2003 |
| 0.029126 | −0.211752 | 8.2003 |
| 0.065591 | −0.194162 | 8.2003 |
| 0.101825 | −0.176101 | 8.2003 |
| 0.137814 | −0.157557 | 8.2003 |
| 0.173544 | −0.138519 | 8.2003 |
| 0.208999 | −0.118974 | 8.2003 |
| 0.244166 | −0.098914 | 8.2003 |
| 0.27903 | −0.078333 | 8.2003 |
| 0.313579 | −0.057226 | 8.2003 |
| 0.347801 | −0.035595 | 8.2003 |
| 0.381693 | −0.013449 | 8.2003 |
| 0.415254 | 0.009194 | 8.2003 |
| 0.448488 | 0.032317 | 8.2003 |
| 0.481393 | 0.055903 | 8.2003 |
| 0.513973 | 0.079937 | 8.2003 |

TABLE 1-continued

| X | Y | Z |
|---|---|---|
| 0.546232 | 0.1044 | 8.2003 |
| 0.57817 | 0.129281 | 8.2003 |
| 0.609789 | 0.154567 | 8.2003 |
| 0.641087 | 0.180248 | 8.2003 |
| 0.672058 | 0.206322 | 8.2003 |
| 0.7027 | 0.232783 | 8.2003 |
| 0.733006 | 0.259628 | 8.2003 |
| 0.762969 | 0.286855 | 8.2003 |
| 0.79258 | 0.314465 | 8.2003 |
| 0.821828 | 0.342458 | 8.2003 |
| 0.850702 | 0.370837 | 8.2003 |
| 0.879187 | 0.399607 | 8.2003 |
| 0.90726 | 0.428778 | 8.2003 |
| 0.934894 | 0.458367 | 8.2003 |
| 0.962058 | 0.488386 | 8.2003 |
| 0.988724 | 0.518849 | 8.2003 |
| 1.014862 | 0.549767 | 8.2003 |
| 1.040436 | 0.581152 | 8.2003 |
| 1.065402 | 0.613023 | 8.2003 |
| 1.089724 | 0.645388 | 8.2003 |
| 1.113345 | 0.678268 | 8.2003 |
| 1.136151 | 0.711719 | 8.2003 |
| 1.157984 | 0.745811 | 8.2003 |
| 1.178574 | 0.780667 | 8.2003 |
| 1.197515 | 0.816442 | 8.2003 |
| 1.213554 | 0.853595 | 8.2003 |
| 1.24953 | 0.899112 | 8.870301 |
| 1.225959 | 0.929483 | 8.870301 |
| 1.1854 | 0.926358 | 8.870301 |
| 1.147178 | 0.911145 | 8.870301 |
| 1.110297 | 0.89288 | 8.870301 |
| 1.074159 | 0.873177 | 8.870301 |
| 1.038401 | 0.852791 | 8.870301 |
| 1.002939 | 0.831894 | 8.870301 |
| 0.967708 | 0.81061 | 8.870301 |
| 0.932677 | 0.788997 | 8.870301 |
| 0.897827 | 0.767094 | 8.870301 |
| 0.863132 | 0.744946 | 8.870301 |
| 0.828564 | 0.722601 | 8.870301 |
| 0.794095 | 0.700104 | 8.870301 |
| 0.759698 | 0.677496 | 8.870301 |
| 0.725353 | 0.65481 | 8.870301 |
| 0.691043 | 0.632069 | 8.870301 |
| 0.656755 | 0.609297 | 8.870301 |
| 0.62248 | 0.586505 | 8.870301 |
| 0.588216 | 0.563696 | 8.870301 |
| 0.553962 | 0.540873 | 8.870301 |
| 0.519715 | 0.518037 | 8.870301 |
| 0.485476 | 0.495192 | 8.870301 |
| 0.451241 | 0.472339 | 8.870301 |
| 0.417007 | 0.449486 | 8.870301 |
| 0.382769 | 0.426638 | 8.870301 |
| 0.348521 | 0.403805 | 8.870301 |
| 0.314261 | 0.380991 | 8.870301 |
| 0.279995 | 0.358185 | 8.870301 |
| 0.245728 | 0.33538 | 8.870301 |
| 0.21147 | 0.312563 | 8.870301 |
| 0.177225 | 0.289725 | 8.870301 |
| 0.143 | 0.266858 | 8.870301 |
| 0.108802 | 0.243951 | 8.870301 |
| 0.074636 | 0.220995 | 8.870301 |
| 0.040509 | 0.197982 | 8.870301 |
| 0.00643 | 0.174897 | 8.870301 |
| −0.027591 | 0.151728 | 8.870301 |
| −0.061555 | 0.128475 | 8.870301 |
| −0.095479 | 0.105164 | 8.870301 |
| −0.129379 | 0.081817 | 8.870301 |
| −0.163269 | 0.058456 | 8.870301 |
| −0.197169 | 0.03511 | 8.870301 |
| −0.2311 | 0.011808 | 8.870301 |
| −0.265077 | −0.011425 | 8.870301 |
| −0.299118 | −0.034567 | 8.870301 |
| −0.333237 | −0.057591 | 8.870301 |
| −0.36745 | −0.080477 | 8.870301 |
| −0.401767 | −0.103206 | 8.870301 |
| −0.436194 | −0.125767 | 8.870301 |
| −0.470735 | −0.148154 | 8.870301 |
| −0.505391 | −0.170363 | 8.870301 |

TABLE 1-continued

| X | Y | Z |
|---|---|---|
| −0.540162 | −0.19239 | 8.870301 |
| −0.575052 | −0.21423 | 8.870301 |
| −0.610066 | −0.23587 | 8.870301 |
| −0.645208 | −0.257301 | 8.870301 |
| −0.680483 | −0.278513 | 8.870301 |
| −0.715892 | −0.2995 | 8.870301 |
| −0.751436 | −0.320257 | 8.870301 |
| −0.787117 | −0.34078 | 8.870301 |
| −0.822932 | −0.361065 | 8.870301 |
| −0.858883 | −0.381111 | 8.870301 |
| −0.894968 | −0.400913 | 8.870301 |
| −0.931203 | −0.42044 | 8.870301 |
| −0.967609 | −0.439645 | 8.870301 |
| −1.004203 | −0.45849 | 8.870301 |
| −1.040998 | −0.47694 | 8.870301 |
| −1.078001 | −0.494968 | 8.870301 |
| −1.115225 | −0.512537 | 8.870301 |
| −1.152695 | −0.529573 | 8.870301 |
| −1.190438 | −0.545996 | 8.870301 |
| −1.228472 | −0.561734 | 8.870301 |
| −1.266809 | −0.57672 | 8.870301 |
| −1.305454 | −0.590894 | 8.870301 |
| −1.330871 | −0.618114 | 8.870301 |
| −1.299185 | −0.634061 | 8.870301 |
| −1.259391 | −0.623534 | 8.870301 |
| −1.219484 | −0.613442 | 8.870301 |
| −1.179487 | −0.603715 | 8.870301 |
| −1.13942 | −0.594278 | 8.870301 |
| −1.099306 | −0.585044 | 8.870301 |
| −1.059166 | −0.575922 | 8.870301 |
| −1.019024 | −0.56681 | 8.870301 |
| −0.978904 | −0.557601 | 8.870301 |
| −0.938818 | −0.548248 | 8.870301 |
| −0.89877 | −0.53873 | 8.870301 |
| −0.858767 | −0.529026 | 8.870301 |
| −0.818815 | −0.519115 | 8.870301 |
| −0.778921 | −0.508971 | 8.870301 |
| −0.739094 | −0.498571 | 8.870301 |
| −0.69934 | −0.487891 | 8.870301 |
| −0.659665 | −0.476923 | 8.870301 |
| −0.620073 | −0.465659 | 8.870301 |
| −0.580569 | −0.454092 | 8.870301 |
| −0.541157 | −0.442212 | 8.870301 |
| −0.501844 | −0.430013 | 8.870301 |
| −0.462633 | −0.417486 | 8.870301 |
| −0.42353 | −0.404626 | 8.870301 |
| −0.38454 | −0.391429 | 8.870301 |
| −0.345667 | −0.37789 | 8.870301 |
| −0.306916 | −0.364005 | 8.870301 |
| −0.268293 | −0.34977 | 8.870301 |
| −0.229805 | −0.335174 | 8.870301 |
| −0.19146 | −0.320204 | 8.870301 |
| −0.153268 | −0.304849 | 8.870301 |
| −0.11524 | −0.289094 | 8.870301 |
| −0.077384 | −0.272927 | 8.870301 |
| −0.039713 | −0.256337 | 8.870301 |
| −0.002236 | −0.239311 | 8.870301 |
| 0.035036 | −0.22184 | 8.870301 |
| 0.072089 | −0.203911 | 8.870301 |
| 0.108911 | −0.185512 | 8.870301 |
| 0.145487 | −0.166628 | 8.870301 |
| 0.181801 | −0.147247 | 8.870301 |
| 0.217838 | −0.127353 | 8.870301 |
| 0.253582 | −0.106939 | 8.870301 |
| 0.289019 | −0.085996 | 8.870301 |
| 0.324135 | −0.064519 | 8.870301 |
| 0.358918 | −0.042507 | 8.870301 |
| 0.393363 | −0.01997 | 8.870301 |
| 0.427468 | 0.003078 | 8.870301 |
| 0.461235 | 0.026619 | 8.870301 |
| 0.494663 | 0.050638 | 8.870301 |
| 0.527759 | 0.075114 | 8.870301 |
| 0.560528 | 0.100025 | 8.870301 |
| 0.592975 | 0.125354 | 8.870301 |
| 0.625107 | 0.151082 | 8.870301 |
| 0.656928 | 0.177193 | 8.870301 |
| 0.688436 | 0.203683 | 8.870301 |
| 0.719628 | 0.230542 | 8.870301 |

TABLE 1-continued

| X | Y | Z |
|---|---|---|
| 0.750499 | 0.25777 | 8.870301 |
| 0.781044 | 0.285363 | 8.870301 |
| 0.811252 | 0.313325 | 8.870301 |
| 0.841111 | 0.341659 | 8.870301 |
| 0.870606 | 0.370372 | 8.870301 |
| 0.899718 | 0.399473 | 8.870301 |
| 0.928424 | 0.428974 | 8.870301 |
| 0.956696 | 0.458892 | 8.870301 |
| 0.984504 | 0.489242 | 8.870301 |
| 1.011815 | 0.520039 | 8.870301 |
| 1.038593 | 0.5513 | 8.870301 |
| 1.064792 | 0.583049 | 8.870301 |
| 1.09035 | 0.615316 | 8.870301 |
| 1.115222 | 0.648114 | 8.870301 |
| 1.139386 | 0.681437 | 8.870301 |
| 1.162796 | 0.715294 | 8.870301 |
| 1.185329 | 0.749741 | 8.870301 |
| 1.206675 | 0.784934 | 8.870301 |
| 1.22622 | 0.821152 | 8.870301 |
| 1.242659 | 0.858868 | 8.870301 |
| 1.278488 | 0.903194 | 9.540301 |
| 1.25485 | 0.933346 | 9.540301 |
| 1.213858 | 0.927421 | 9.540301 |
| 1.175601 | 0.910545 | 9.540301 |
| 1.138743 | 0.890766 | 9.540301 |
| 1.102552 | 0.869784 | 9.540301 |
| 1.066682 | 0.848256 | 9.540301 |
| 1.03108 | 0.826289 | 9.540301 |
| 0.995706 | 0.803955 | 9.540301 |
| 0.960526 | 0.781317 | 9.540301 |
| 0.92551 | 0.758428 | 9.540301 |
| 0.890628 | 0.735332 | 9.540301 |
| 0.855854 | 0.712076 | 9.540301 |
| 0.821157 | 0.688705 | 9.540301 |
| 0.786507 | 0.665264 | 9.540301 |
| 0.751886 | 0.64178 | 9.540301 |
| 0.717283 | 0.61827 | 9.540301 |
| 0.682691 | 0.594743 | 9.540301 |
| 0.648105 | 0.571207 | 9.540301 |
| 0.613522 | 0.547668 | 9.540301 |
| 0.578939 | 0.524129 | 9.540301 |
| 0.544352 | 0.500594 | 9.540301 |
| 0.50976 | 0.477069 | 9.540301 |
| 0.475157 | 0.453558 | 9.540301 |
| 0.440542 | 0.430066 | 9.540301 |
| 0.405909 | 0.406599 | 9.540301 |
| 0.371256 | 0.383163 | 9.540301 |
| 0.336583 | 0.359756 | 9.540301 |
| 0.301895 | 0.336372 | 9.540301 |
| 0.267195 | 0.313005 | 9.540301 |
| 0.232487 | 0.289649 | 9.540301 |
| 0.197777 | 0.266297 | 9.540301 |
| 0.163068 | 0.242943 | 9.540301 |
| 0.128367 | 0.219579 | 9.540301 |
| 0.093676 | 0.196198 | 9.540301 |
| 0.058998 | 0.172798 | 9.540301 |
| 0.024333 | 0.149379 | 9.540301 |
| −0.010318 | 0.125941 | 9.540301 |
| −0.044966 | 0.102496 | 9.540301 |
| −0.07962 | 0.079061 | 9.540301 |
| −0.114289 | 0.055648 | 9.540301 |
| −0.148984 | 0.032274 | 9.540301 |
| −0.183717 | 0.008957 | 9.540301 |
| −0.218498 | −0.014289 | 9.540301 |
| −0.253337 | −0.037449 | 9.540301 |
| −0.288251 | −0.060496 | 9.540301 |
| −0.323255 | −0.083404 | 9.540301 |
| −0.358363 | −0.106153 | 9.540301 |
| −0.393587 | −0.128723 | 9.540301 |
| −0.428927 | −0.151109 | 9.540301 |
| −0.464384 | −0.173311 | 9.540301 |
| −0.499958 | −0.195325 | 9.540301 |
| −0.535647 | −0.217151 | 9.540301 |
| −0.571454 | −0.238783 | 9.540301 |
| −0.607385 | −0.260209 | 9.540301 |
| −0.643441 | −0.281423 | 9.540301 |
| −0.679626 | −0.302417 | 9.540301 |
| −0.715941 | −0.323187 | 9.540301 |

TABLE 1-continued

| X | Y | Z |
|---|---|---|
| −0.752385 | −0.343727 | 9.540301 |
| −0.788959 | −0.364036 | 9.540301 |
| −0.825661 | −0.384111 | 9.540301 |
| −0.862491 | −0.403952 | 9.540301 |
| −0.899451 | −0.42355 | 9.540301 |
| −0.936568 | −0.442849 | 9.540301 |
| −0.973872 | −0.461783 | 9.540301 |
| −1.011387 | −0.480297 | 9.540301 |
| −1.04913 | −0.498339 | 9.540301 |
| −1.087115 | −0.515868 | 9.540301 |
| −1.125345 | −0.532855 | 9.540301 |
| −1.163815 | −0.549292 | 9.540301 |
| −1.202518 | −0.565173 | 9.540301 |
| −1.241446 | −0.580492 | 9.540301 |
| −1.280592 | −0.595246 | 9.540301 |
| −1.319949 | −0.60943 | 9.540301 |
| −1.346959 | −0.636634 | 9.540301 |
| −1.317076 | −0.657109 | 9.540301 |
| −1.276617 | −0.646554 | 9.540301 |
| −1.236093 | −0.636252 | 9.540301 |
| −1.195514 | −0.626166 | 9.540301 |
| −1.154891 | −0.616257 | 9.540301 |
| −1.114237 | −0.60648 | 9.540301 |
| −1.073562 | −0.596787 | 9.540301 |
| −1.03288 | −0.587126 | 9.540301 |
| −0.992203 | −0.577442 | 9.540301 |
| −0.951542 | −0.567693 | 9.540301 |
| −0.910906 | −0.557839 | 9.540301 |
| −0.870307 | −0.547835 | 9.540301 |
| −0.829756 | −0.537634 | 9.540301 |
| −0.78927 | −0.527184 | 9.540301 |
| −0.748863 | −0.516429 | 9.540301 |
| −0.708548 | −0.505335 | 9.540301 |
| −0.668328 | −0.493902 | 9.540301 |
| −0.628205 | −0.482129 | 9.540301 |
| −0.588184 | −0.470019 | 9.540301 |
| −0.548264 | −0.457576 | 9.540301 |
| −0.508449 | −0.444804 | 9.540301 |
| −0.468741 | −0.431702 | 9.540301 |
| −0.429144 | −0.418269 | 9.540301 |
| −0.389662 | −0.404503 | 9.540301 |
| −0.350297 | −0.390404 | 9.540301 |
| −0.311053 | −0.375972 | 9.540301 |
| −0.271934 | −0.361203 | 9.540301 |
| −0.232948 | −0.346089 | 9.540301 |
| −0.194101 | −0.330619 | 9.540301 |
| −0.155403 | −0.314781 | 9.540301 |
| −0.116862 | −0.298567 | 9.540301 |
| −0.078487 | −0.28196 | 9.540301 |
| −0.040291 | −0.264947 | 9.540301 |
| −0.002287 | −0.247509 | 9.540301 |
| 0.03551 | −0.229628 | 9.540301 |
| 0.073087 | −0.211288 | 9.540301 |
| 0.110429 | −0.192475 | 9.540301 |
| 0.147523 | −0.173177 | 9.540301 |
| 0.184353 | −0.153382 | 9.540301 |
| 0.220907 | −0.133078 | 9.540301 |
| 0.257168 | −0.112259 | 9.540301 |
| 0.293126 | −0.090918 | 9.540301 |
| 0.328765 | −0.069051 | 9.540301 |
| 0.364079 | −0.046661 | 9.540301 |
| 0.399059 | −0.023754 | 9.540301 |
| 0.433705 | −0.000344 | 9.540301 |
| 0.468015 | 0.023556 | 9.540301 |
| 0.501991 | 0.047927 | 9.540301 |
| 0.535642 | 0.072747 | 9.540301 |
| 0.56897 | 0.097997 | 9.540301 |
| 0.601981 | 0.123661 | 9.540301 |
| 0.63468 | 0.149721 | 9.540301 |
| 0.667067 | 0.176168 | 9.540301 |
| 0.699142 | 0.202993 | 9.540301 |
| 0.730905 | 0.230186 | 9.540301 |
| 0.762361 | 0.257734 | 9.540301 |
| 0.793509 | 0.285629 | 9.540301 |
| 0.824347 | 0.313868 | 9.540301 |
| 0.854868 | 0.342448 | 9.540301 |
| 0.885064 | 0.371371 | 9.540301 |
| 0.914922 | 0.400643 | 9.540301 |

TABLE 1-continued

| X | Y | Z |
|---|---|---|
| 0.944421 | 0.430278 | 9.540301 |
| 0.973524 | 0.4603 | 9.540301 |
| 1.002187 | 0.490744 | 9.540301 |
| 1.030357 | 0.521643 | 9.540301 |
| 1.057978 | 0.553034 | 9.540301 |
| 1.08498 | 0.58496 | 9.540301 |
| 1.111277 | 0.617467 | 9.540301 |
| 1.136822 | 0.65057 | 9.540301 |
| 1.161621 | 0.684235 | 9.540301 |
| 1.185685 | 0.718428 | 9.540301 |
| 1.20899 | 0.753145 | 9.540301 |
| 1.231317 | 0.788496 | 9.540301 |
| 1.252035 | 0.824809 | 9.540301 |
| 1.269865 | 0.862614 | 9.540301 |
| 1.306621 | 0.908737 | 10.210299 |
| 1.280843 | 0.93647 | 10.210299 |
| 1.239765 | 0.927358 | 10.210299 |
| 1.201614 | 0.908803 | 10.210299 |
| 1.164665 | 0.887939 | 10.210299 |
| 1.128312 | 0.866047 | 10.210299 |
| 1.092292 | 0.843611 | 10.210299 |
| 1.056545 | 0.820745 | 10.210299 |
| 1.021008 | 0.797551 | 10.210299 |
| 0.985636 | 0.774106 | 10.210299 |
| 0.950387 | 0.750477 | 10.210299 |
| 0.915226 | 0.726718 | 10.210299 |
| 0.880129 | 0.702863 | 10.210299 |
| 0.845078 | 0.678942 | 10.210299 |
| 0.810057 | 0.654977 | 10.210299 |
| 0.775057 | 0.630981 | 10.210299 |
| 0.740076 | 0.606957 | 10.210299 |
| 0.705112 | 0.582908 | 10.210299 |
| 0.670158 | 0.558845 | 10.210299 |
| 0.635201 | 0.534786 | 10.210299 |
| 0.600228 | 0.510751 | 10.210299 |
| 0.565226 | 0.486757 | 10.210299 |
| 0.530179 | 0.462831 | 10.210299 |
| 0.495072 | 0.438991 | 10.210299 |
| 0.459901 | 0.415246 | 10.210299 |
| 0.424665 | 0.391598 | 10.210299 |
| 0.389369 | 0.368039 | 10.210299 |
| 0.354021 | 0.344559 | 10.210299 |
| 0.318631 | 0.321142 | 10.210299 |
| 0.28321 | 0.297772 | 10.210299 |
| 0.247768 | 0.274432 | 10.210299 |
| 0.21232 | 0.251104 | 10.210299 |
| 0.176874 | 0.227771 | 10.210299 |
| 0.141445 | 0.204414 | 10.210299 |
| 0.106046 | 0.18101 | 10.210299 |
| 0.07069 | 0.157541 | 10.210299 |
| 0.035384 | 0.133998 | 10.210299 |
| 0.000132 | 0.110373 | 10.210299 |
| −0.035064 | 0.086665 | 10.210299 |
| −0.070219 | 0.062897 | 10.210299 |
| −0.105365 | 0.039115 | 10.210299 |
| −0.140528 | 0.015359 | 10.210299 |
| −0.175736 | −0.008332 | 10.210299 |
| −0.211018 | −0.031911 | 10.210299 |
| −0.246401 | −0.055338 | 10.210299 |
| −0.281908 | −0.078578 | 10.210299 |
| −0.317554 | −0.101604 | 10.210299 |
| −0.353346 | −0.124401 | 10.210299 |
| −0.38929 | −0.146959 | 10.210299 |
| −0.42539 | −0.169266 | 10.210299 |
| −0.461638 | −0.191332 | 10.210299 |
| −0.498015 | −0.213184 | 10.210299 |
| −0.534505 | −0.234847 | 10.210299 |
| −0.571093 | −0.256344 | 10.210299 |
| −0.60777 | −0.277689 | 10.210299 |
| −0.644543 | −0.298869 | 10.210299 |
| −0.68142 | −0.319867 | 10.210299 |
| −0.718407 | −0.34067 | 10.210299 |
| −0.755508 | −0.36127 | 10.210299 |
| −0.792726 | −0.381655 | 10.210299 |
| −0.830074 | −0.401804 | 10.210299 |
| −0.867561 | −0.421691 | 10.210299 |
| −0.905201 | −0.441289 | 10.210299 |
| −0.943006 | −0.460565 | 10.210299 |

TABLE 1-continued

| X | Y | Z |
|---|---|---|
| −0.98099 | −0.479488 | 10.210299 |
| −1.01916 | −0.49803 | 10.210299 |
| −1.057528 | −0.516162 | 10.210299 |
| −1.096105 | −0.533842 | 10.210299 |
| −1.134911 | −0.551016 | 10.210299 |
| −1.173967 | −0.567613 | 10.210299 |
| −1.213279 | −0.583593 | 10.210299 |
| −1.25283 | −0.598972 | 10.210299 |
| −1.292599 | −0.613778 | 10.210299 |
| −1.332561 | −0.628055 | 10.210299 |
| −1.360677 | −0.655201 | 10.210299 |
| −1.330568 | −0.676396 | 10.210299 |
| −1.289367 | −0.667244 | 10.210299 |
| −1.248089 | −0.657395 | 10.210299 |
| −1.206935 | −0.647039 | 10.210299 |
| −1.165872 | −0.636325 | 10.210299 |
| −1.124862 | −0.625412 | 10.210299 |
| −1.083862 | −0.614462 | 10.210299 |
| −1.042827 | −0.603646 | 10.210299 |
| −1.001715 | −0.593124 | 10.210299 |
| −0.960528 | −0.582897 | 10.210299 |
| −0.919296 | −0.572858 | 10.210299 |
| −0.878045 | −0.562893 | 10.210299 |
| −0.836806 | −0.552883 | 10.210299 |
| −0.79561 | −0.542696 | 10.210299 |
| −0.754495 | −0.532183 | 10.210299 |
| −0.713506 | −0.521192 | 10.210299 |
| −0.672659 | −0.509685 | 10.210299 |
| −0.631953 | −0.497688 | 10.210299 |
| −0.591384 | −0.485236 | 10.210299 |
| −0.550943 | −0.472375 | 10.210299 |
| −0.510615 | −0.459161 | 10.210299 |
| −0.470385 | −0.445654 | 10.210299 |
| −0.430253 | −0.431861 | 10.210299 |
| −0.390227 | −0.417759 | 10.210299 |
| −0.35032 | −0.403324 | 10.210299 |
| −0.310546 | −0.38853 | 10.210299 |
| −0.270918 | −0.373347 | 10.210299 |
| −0.231448 | −0.357756 | 10.210299 |
| −0.192144 | −0.341755 | 10.210299 |
| −0.153008 | −0.325345 | 10.210299 |
| −0.114045 | −0.308529 | 10.210299 |
| −0.075258 | −0.291311 | 10.210299 |
| −0.03665 | −0.273694 | 10.210299 |
| 0.001774 | −0.25568 | 10.210299 |
| 0.040011 | −0.237273 | 10.210299 |
| 0.078058 | −0.218476 | 10.210299 |
| 0.115908 | −0.199287 | 10.210299 |
| 0.153545 | −0.179682 | 10.210299 |
| 0.190949 | −0.159636 | 10.210299 |
| 0.228097 | −0.13912 | 10.210299 |
| 0.264965 | −0.118105 | 10.210299 |
| 0.301527 | −0.096561 | 10.210299 |
| 0.33775 | −0.074453 | 10.210299 |
| 0.373605 | −0.051753 | 10.210299 |
| 0.409084 | −0.028471 | 10.210299 |
| 0.444195 | −0.004635 | 10.210299 |
| 0.478948 | 0.019718 | 10.210299 |
| 0.513355 | 0.044559 | 10.210299 |
| 0.547425 | 0.069859 | 10.210299 |
| 0.581176 | 0.095584 | 10.210299 |
| 0.614619 | 0.121708 | 10.210299 |
| 0.647765 | 0.148208 | 10.210299 |
| 0.680628 | 0.175058 | 10.210299 |
| 0.713208 | 0.202249 | 10.210299 |
| 0.74551 | 0.229772 | 10.210299 |
| 0.777527 | 0.257625 | 10.210299 |
| 0.809254 | 0.285808 | 10.210299 |
| 0.840681 | 0.314325 | 10.210299 |
| 0.871796 | 0.343183 | 10.210299 |
| 0.902584 | 0.372389 | 10.210299 |
| 0.933025 | 0.401956 | 10.210299 |
| 0.96309 | 0.431906 | 10.210299 |
| 0.992742 | 0.462264 | 10.210299 |
| 1.021943 | 0.493057 | 10.210299 |
| 1.05065 | 0.52431 | 10.210299 |
| 1.078824 | 0.556044 | 10.210299 |
| 1.106421 | 0.588282 | 10.210299 |

TABLE 1-continued

| X | Y | Z |
|---|---|---|
| 1.133368 | 0.621065 | 10.210299 |
| 1.15961 | 0.654414 | 10.210299 |
| 1.185121 | 0.688326 | 10.210299 |
| 1.209871 | 0.722797 | 10.210299 |
| 1.233779 | 0.757857 | 10.210299 |
| 1.256566 | 0.793655 | 10.210299 |
| 1.277953 | 0.830305 | 10.210299 |
| 1.297422 | 0.868001 | 10.210299 |
| 1.334233 | 0.917739 | 10.880301 |
| 1.303294 | 0.940526 | 10.880301 |
| 1.262142 | 0.929149 | 10.880301 |
| 1.223454 | 0.910312 | 10.880301 |
| 1.185763 | 0.889533 | 10.880301 |
| 1.14873 | 0.867601 | 10.880301 |
| 1.112133 | 0.844948 | 10.880301 |
| 1.075884 | 0.821741 | 10.880301 |
| 1.039834 | 0.798227 | 10.880301 |
| 1.003906 | 0.774527 | 10.880301 |
| 0.968053 | 0.750712 | 10.880301 |
| 0.93225 | 0.726823 | 10.880301 |
| 0.89649 | 0.70287 | 10.880301 |
| 0.860773 | 0.678852 | 10.880301 |
| 0.825104 | 0.654764 | 10.880301 |
| 0.789483 | 0.630603 | 10.880301 |
| 0.753908 | 0.606376 | 10.880301 |
| 0.718373 | 0.58209 | 10.880301 |
| 0.682865 | 0.557765 | 10.880301 |
| 0.647362 | 0.533432 | 10.880301 |
| 0.611839 | 0.509129 | 10.880301 |
| 0.576268 | 0.484895 | 10.880301 |
| 0.540621 | 0.460773 | 10.880301 |
| 0.504872 | 0.436804 | 10.880301 |
| 0.468998 | 0.413022 | 10.880301 |
| 0.433005 | 0.389419 | 10.880301 |
| 0.396912 | 0.365971 | 10.880301 |
| 0.360739 | 0.342646 | 10.880301 |
| 0.324508 | 0.319411 | 10.880301 |
| 0.288241 | 0.296232 | 10.880301 |
| 0.251963 | 0.27307 | 10.880301 |
| 0.215696 | 0.249893 | 10.880301 |
| 0.179461 | 0.226663 | 10.880301 |
| 0.143281 | 0.203349 | 10.880301 |
| 0.10718 | 0.179913 | 10.880301 |
| 0.071185 | 0.156315 | 10.880301 |
| 0.035313 | 0.132528 | 10.880301 |
| −0.000422 | 0.108539 | 10.880301 |
| −0.036016 | 0.084339 | 10.880301 |
| −0.071474 | 0.059941 | 10.880301 |
| −0.106853 | 0.035429 | 10.880301 |
| −0.142215 | 0.010891 | 10.880301 |
| −0.177614 | −0.013593 | 10.880301 |
| −0.213104 | −0.037946 | 10.880301 |
| −0.248732 | −0.062095 | 10.880301 |
| −0.284538 | −0.085978 | 10.880301 |
| −0.320545 | −0.109559 | 10.880301 |
| −0.356746 | −0.13284 | 10.880301 |
| −0.393135 | −0.155828 | 10.880301 |
| −0.429703 | −0.178528 | 10.880301 |
| −0.466437 | −0.200958 | 10.880301 |
| −0.503311 | −0.223159 | 10.880301 |
| −0.540299 | −0.245169 | 10.880301 |
| −0.577379 | −0.267024 | 10.880301 |
| −0.614535 | −0.288749 | 10.880301 |
| −0.651772 | −0.310334 | 10.880301 |
| −0.689099 | −0.331764 | 10.880301 |
| −0.726525 | −0.353021 | 10.880301 |
| −0.76406 | −0.374085 | 10.880301 |
| −0.801713 | −0.394936 | 10.880301 |
| −0.839492 | −0.415559 | 10.880301 |
| −0.877407 | −0.435931 | 10.880301 |
| −0.915472 | −0.45602 | 10.880301 |
| −0.953707 | −0.475785 | 10.880301 |
| −0.99212 | −0.495199 | 10.880301 |
| −1.030718 | −0.514247 | 10.880301 |
| −1.069501 | −0.532912 | 10.880301 |
| −1.108472 | −0.551182 | 10.880301 |
| −1.147651 | −0.569002 | 10.880301 |
| −1.187069 | −0.586286 | 10.880301 |

TABLE 1-continued

| X | Y | Z |
|---|---|---|
| −1.226758 | −0.602937 | 10.880301 |
| −1.266742 | −0.61887 | 10.880301 |
| −1.307008 | −0.634072 | 10.880301 |
| −1.347541 | −0.648551 | 10.880301 |
| −1.371558 | −0.678575 | 10.880301 |
| −1.336349 | −0.693298 | 10.880301 |
| −1.294249 | −0.684243 | 10.880301 |
| −1.252396 | −0.674113 | 10.880301 |
| −1.210733 | −0.663224 | 10.880301 |
| −1.16919 | −0.651887 | 10.880301 |
| −1.127687 | −0.640406 | 10.880301 |
| −1.086143 | −0.629071 | 10.880301 |
| −1.044489 | −0.618152 | 10.880301 |
| −1.002712 | −0.607711 | 10.880301 |
| −0.960853 | −0.597604 | 10.880301 |
| −0.918948 | −0.587686 | 10.880301 |
| −0.877033 | −0.577816 | 10.880301 |
| −0.835142 | −0.567844 | 10.880301 |
| −0.793315 | −0.557605 | 10.880301 |
| −0.7516 | −0.546919 | 10.880301 |
| −0.71002 | −0.535716 | 10.880301 |
| −0.668579 | −0.524015 | 10.880301 |
| −0.627271 | −0.51185 | 10.880301 |
| −0.586089 | −0.499266 | 10.880301 |
| −0.545018 | −0.486321 | 10.880301 |
| −0.504042 | −0.473083 | 10.880301 |
| −0.463159 | −0.459559 | 10.880301 |
| −0.422382 | −0.445716 | 10.880301 |
| −0.381728 | −0.431517 | 10.880301 |
| −0.341215 | −0.416923 | 10.880301 |
| −0.300864 | −0.401887 | 10.880301 |
| −0.260689 | −0.386384 | 10.880301 |
| −0.220697 | −0.370417 | 10.880301 |
| −0.18089 | −0.353994 | 10.880301 |
| −0.141269 | −0.337127 | 10.880301 |
| −0.101833 | −0.319831 | 10.880301 |
| −0.06258 | −0.302126 | 10.880301 |
| −0.023504 | −0.284031 | 10.880301 |
| 0.015401 | −0.265572 | 10.880301 |
| 0.054146 | −0.246779 | 10.880301 |
| 0.092733 | −0.227665 | 10.880301 |
| 0.131155 | −0.20822 | 10.880301 |
| 0.169402 | −0.188434 | 10.880301 |
| 0.207463 | −0.168293 | 10.880301 |
| 0.245305 | −0.147742 | 10.880301 |
| 0.282872 | −0.126695 | 10.880301 |
| 0.320099 | −0.105051 | 10.880301 |
| 0.356926 | −0.082734 | 10.880301 |
| 0.393339 | −0.059747 | 10.880301 |
| 0.429333 | −0.036109 | 10.880301 |
| 0.464912 | −0.011851 | 10.880301 |
| 0.500089 | 0.012985 | 10.880301 |
| 0.534892 | 0.038343 | 10.880301 |
| 0.569351 | 0.064168 | 10.880301 |
| 0.603486 | 0.090419 | 10.880301 |
| 0.637328 | 0.117047 | 10.880301 |
| 0.670906 | 0.144007 | 10.880301 |
| 0.704253 | 0.171252 | 10.880301 |
| 0.737386 | 0.198757 | 10.880301 |
| 0.770279 | 0.226549 | 10.880301 |
| 0.802901 | 0.254658 | 10.880301 |
| 0.835223 | 0.283112 | 10.880301 |
| 0.867211 | 0.311939 | 10.880301 |
| 0.898824 | 0.341179 | 10.880301 |
| 0.930008 | 0.370874 | 10.880301 |
| 0.960706 | 0.401073 | 10.880301 |
| 0.99089 | 0.431785 | 10.880301 |
| 1.02056 | 0.462994 | 10.880301 |
| 1.04974 | 0.494661 | 10.880301 |
| 1.078474 | 0.526734 | 10.880301 |
| 1.106811 | 0.559158 | 10.880301 |
| 1.134742 | 0.591932 | 10.880301 |
| 1.162195 | 0.625108 | 10.880301 |
| 1.189079 | 0.658746 | 10.880301 |
| 1.215248 | 0.692943 | 10.880301 |
| 1.240507 | 0.727817 | 10.880301 |
| 1.264329 | 0.763684 | 10.880301 |
| 1.286527 | 0.800581 | 10.880301 |

TABLE 1-continued

| X | Y | Z |
|---|---|---|
| 1.308076 | 0.837864 | 10.880301 |
| 1.32787 | 0.876055 | 10.880301 |

Figure 6:
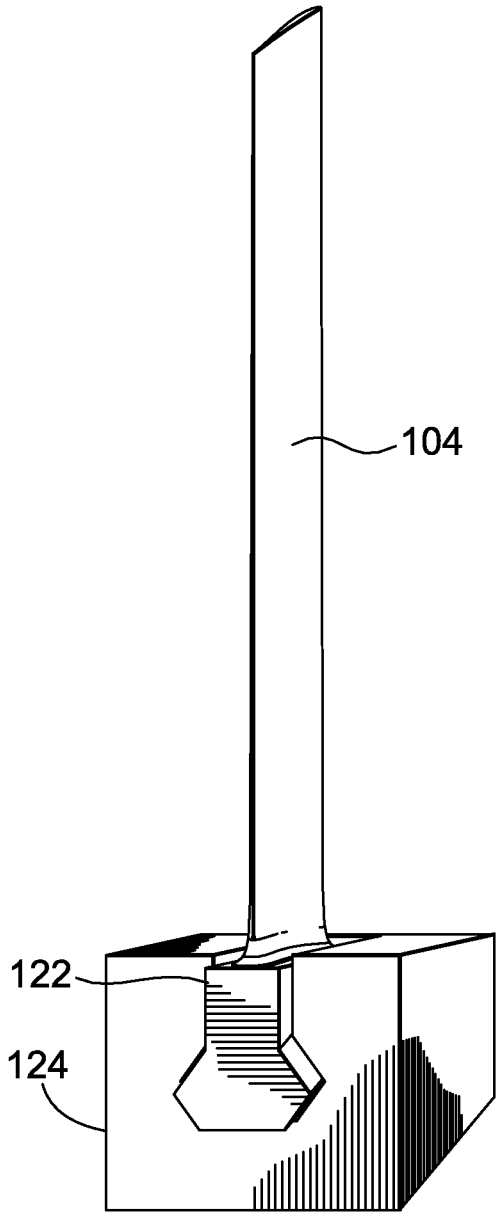

An alternate embodiment of the present invention is shown in FIG. 6, where the attachment 102 utilizes one or more attachment surfaces that are oriented so as to correspond with a slot 122 in a compressor disk or carrier segment 124 that has a matching profile to secure the compressor component 100 in place. Such an engagement maintains the compressor component 100 within the carrier 124, preventing it from moving outward due to radial pulling and airflow passing therethrough.

An additional benefit of the carrier 124 is its ability to provide dampening of vibrations of the compressor component 100. The prior art arrangement of the carrier was fabricated from A515 steel and the compressor component was fabricated from a precipitation-hardenable grade of Carpenter Custom 450 stainless steel (CC 450), which together were subject to corrosion, and because of this corrosion the prior art compressor component locked with the carrier during operation. As a result, any damping benefit gained by the interaction of the component and carrier segment was lost due to the corrosion.

The compressor component 100 slides into the carrier 124, and due to the associated tolerances, the compressor component 100 can move relative to the carrier 124 during operations, and such movement allows for dampening of vibrations in the airfoil 104. The compressor component 100 is fabricated from CC 450 stainless steel and the carrier 124 is fabricated from Nitronic 60, a more corrosion-resistant material. The difference in materials significantly reduces any corrosion between the compressor component 100 and carrier 124, and as such, the carrier 124 is capable of dampening vibrations of the compressor component 100.

The present invention has been described in relation to particular embodiments, which are intended in all respects to be illustrative rather than restrictive. Alternative embodiments will become apparent to those of ordinary skill in the art to which the present invention pertains without departing from its scope.

As a result of the thickness change, other factors such as airfoil shape, pressure loss, and overall compressor performance are impacted. Care is taken to minimize any adverse effects from the airfoil thickness changes. Despite the thickness change, the general airfoil shape is maintained while the pressure loss across this stage compressor vane has increased approximately 6.3%. However, because most axial compressors have multiple stages, the overall performance impact on the compressor is negligible (approximately 0.01% loss in efficiency). Therefore, the benefits of an alternate natural frequency through airfoil thickness changes can be achieved without adverse effect to the overall compressor performance.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and within the scope of the claims.

What is claimed is:

1. A compressor component comprising:

an attachment;

an airfoil extending radially outward from the attachment, the airfoil having a leading edge and a trailing edge with the trailing edge spaced a distance from the leading edge and separated by concave and convex surfaces, the airfoil having a thickness between the concave surface and convex surface wherein the thickness varies non-linearly along an airfoil span, as measured in a radial direction from the attachment to an airfoil tip;

wherein the thickness at approximately 15%-25% along the airfoil span is greater than the thickness at approximately 35% along the airfoil span and the thickness at least approximately 40%-80% along the airfoil span is greater than the thickness at approximately 15-25% along the airfoil span.

2. The compressor component of claim 1, wherein the airfoil is solid.

3. The compressor component of claim 1 is a stator vane.

4. The compressor component of claim 1 is a rotating compressor blade.

5. The compressor component of claim 1, wherein a maximum thickness is located at approximately 60% along the span.

6. The compressor component of claim 5, wherein the maximum thickness is approximately twice a minimum thickness of the airfoil.

7. The compressor component of claim 1, further comprising a carrier comprising a series of slots.

8. The compressor component of claim 7, wherein the support ring is fabricated from a steel material such that the support ring and attachment of the compressor component interact in a manner through which the support ring dampens vibrations of the compressor component.

9. A compressor component having an attachment and an airfoil extending radially outward from the attachment, the airfoil having an uncoated profile substantially in accordance with Cartesian coordinate values of X and Y, for each distance Z in inches as set forth in Table 1, wherein Z is a distance measured radially outward from a bottom face of the attachment, the X and Y coordinate values being joined in smooth continuing splines to form airfoil sections and the airfoil sections joined smoothly to form the profile.

10. The compressor component of claim 9, wherein the airfoil has manufacturing tolerances of approximately +/−0.090 inches.

11. The compressor component of claim 10, wherein the compressor component is a stationary vane.

12. The compressor component of claim 10, wherein the compressor component is located adjacent to stages of rotating compressor blades.

13. The compressor component of claim 10 further comprising a coating applied to at least a portion of the airfoil, the coating having a thickness of up to approximately 0.010 inches.

14. The compressor component of claim 10, wherein the airfoil sections can be scaled larger or smaller uniformly.

15. A compressor stator vane having an increased natural frequency comprising:

an attachment; and an airfoil extending radially outward from the attachment, the airfoil having a thickness that varies non-linearly along a span length of the airfoil such that the thickness has at least a first maximum thickness at approximately 20% along the span, a second maximum thickness at approximately 60% along the span, and a reduced thickness portion positioned along the airfoil span between the first maximum thickness and the second maximum thickness, wherein the second maximum thickness is greater than the first maximum thickness.

16. The compressor stator vane of claim 15, wherein the non-linear variation in thickness causes at least a 10% increase in weight to the compressor stator.

17. The compressor stator vane of claim 15, further comprising at least a concave surface and convex surface which extend radially outward from the attachment and are formed by smoothly joining airfoil sections together to form the profile.

* * * * *